US006584740B2

(12) United States Patent
Record

(10) Patent No.: US 6,584,740 B2
(45) Date of Patent: Jul. 1, 2003

(54) FRAMELESS BUILDING SYSTEM

(75) Inventor: Grant C. Record, Twin Falls, ID (US)

(73) Assignee: Leading Edge Earth Products, Inc., Chicago, IL (US)

( * ) Notice: Subject to any disclaimer, the term of this patent is extended or adjusted under 35 U.S.C. 154(b) by 0 days.

(21) Appl. No.: 10/115,881

(22) Filed: Apr. 3, 2002

(65) Prior Publication Data

US 2003/0033769 A1 Feb. 20, 2003

Related U.S. Application Data

(63) Continuation of application No. 09/624,541, filed on Jul. 24, 2000, now abandoned.
(60) Provisional application No. 60/145,472, filed on Jul. 23, 1999.

(51) Int. Cl.[7] ..... E04B 1/00
(52) U.S. Cl. ..... 52/270; 52/309.9; 52/745.05
(58) Field of Search ..... 52/650.1, 783.1, 52/582.1, 284, 309.9, 745.05, 800.12, 270, 309.14, 309.15, 405.1, 405.2, 588.1

(56) References Cited

U.S. PATENT DOCUMENTS 5,509,242 A * 4/1996 Rechsteiner et al. ..... 52/270
6,253,530 B1 * 7/2001 Price et al. ..... 52/793.1
6,298,619 B1 * 10/2001 Davie ..... 52/293.3

* cited by examiner

*Primary Examiner*—Carl D. Friedman
*Assistant Examiner*—Naoko Slack
(74) *Attorney, Agent, or Firm*—Perkins Coie LLP

(57) ABSTRACT

A structural building system comprised of interconnected improved, frameless structural-load-bearing panel components, each panel component having front and back sections, an insulating core, integral symmetrical joinery, a thermal break, and at least one shear resistance connector. The panels are asymmetrical about one axis, and are designed to be directionally positioned with respect to the maximum anticipated shear force. The panel components interconnect to form frameless panel sections out of which the building system is constructed, which requires no exterior framing support members. The panel component and the resultant panel sections resist all three primary directions of force required of structural wall, roof and floor systems; the panel sections being yet stronger than the individual panel components. The panel sections can be used to construct structural walls, floors, ceilings and roofs to form complete building structures, or alternatively, conventional flooring and/or ceiling and/or roof materials may be combined with the interconnected frameless wall panel sections to form complete building structures.

43 Claims, 17 Drawing Sheets

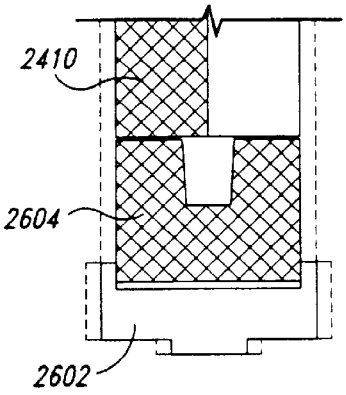
Fig. 26
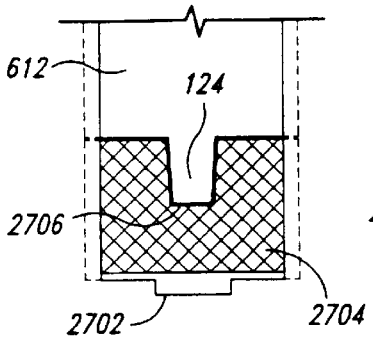
Fig. 27
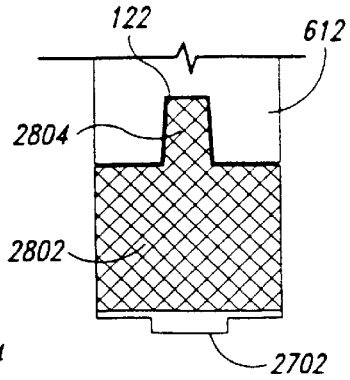
Fig. 28
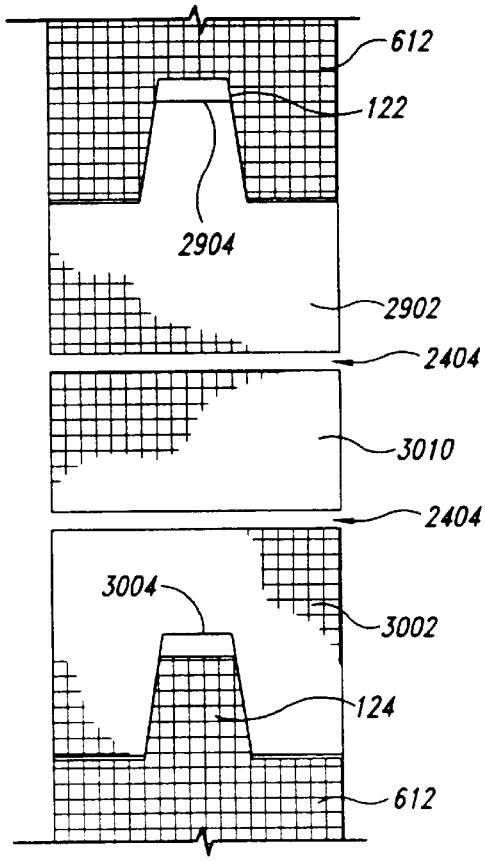
Fig. 29
Fig. 30

FRAMELESS BUILDING SYSTEM

CROSS REFERENCE TO RELATED APPLICATION

This application is a continuation of U.S. patent application Ser. No. 09/624,541 filed Jul. 24, 2000, now abandoned which application claims the benefit of U.S. Provisional Application No. 60/145,472, filed Jul. 23, 1999.

TECHNICAL FIELD

This invention relates to building systems used in building construction and, more particularly, to premanufactured, composite building panels or other composite building components that combine to form structured panel sections usable for rapid construction of frameless buildings, which exhibit improved strength, weight, insulation and other efficiency characteristics.

BACKGROUND OF THE INVENTION

Recent changes in today's housing industry have led to increased use by builders of premanufactured or modular construction components. Premanufactured building components, such as panels, are used for walls, roofs, floors, doors, and other components of a building. Premanufactured building components are desirable because they decrease greatly the time and expense involved in constructing new building structures as compared to traditional component construction which utilizes large quantities of masonry, wood, metal, or concrete components that are assembled by laborers at the job sites in time consuming, complicated and expensive processes.

The premanufactured building components for structural-load-bearing panels must, however, comply with a number of required specifications based on structural criteria, such as axial load-bearing, shear and racking strengths, and total weight of the components. Additional criteria that may affect the specifications of the components include fire resistance, thermal insulation efficiency, sound abating properties, rot and insect resistance, and water resistance. The types of premanufactured building components that can be designed, assembled and shipped to meet all of these specifications are narrowly defined and highly specific and toleranced compared to traditional component construction. Further, premanufactured building components require specialized in-plant workforces to manufacture. The resultant high quality, preferred premanufactured building component is readily transportable, efficiently packaged, and easily handled for the job site.

Premanufactured components for building construction have in the past had a variety of constructions. A common component is a laminated or composite panel. One such composite panel includes a core material of foam or other insulating material positioned between wood members, and the combination is fixed together by nails, screws, or adhesives. These wood composite panels suffer from the disadvantage of being combustible and not mechanically stable enough for many construction applications. These wood composite panels are subject to rot, decay, and insect attack. Accordingly, wood composite panels are not deemed satisfactory for a large cross-section of modern building applications. In one variation of the wood-composite building panel, a laminated skin is fixed to the outside wood members. These panels with the laminated skin are more expensive to manufacture while suffering from the same inadequacies as the panels without the laminated skins.

A significant improvement to the building component technology was developed and set forth in my U.S. Pat. No. 5,440,846, which is hereby incorporated by reference in its entirety. The improved technology provides a structural building component, having front and back side panels positioned opposite each other, and a plurality of joining sides positioned intermediate the front and back side panels so as to substantially define a six-sided structure having an interior area therein. An insulating core positioned in the interior area has a plurality of throughholes extending between the front and back side panels. A plurality of individual shear resistance connectors are positioned in the throughholes and adhered to the front and back side panels.

Constructing the building component using the shear resistance connectors substantially increases the shear strength of the component. As a result, improved building components can be constructed to vary the load-bearing strength vs. weight characteristics of the building components by varying the thicknesses, densities and configurations of the side panels and the joining sides, and by varying the number, configuration and positioning of the shear resistance connectors. Accordingly, a person can design a building structure, determine the structural requirements for the building components, and then select a desired load-bearing strength, shear strength, and weight of the building panels to meet the structural requirements, and then construct the appropriate specified panel required for the defined application.

The improved building components with shear resistance connectors can be very strong, lightweight, and versatile building components, compared to similar panels without the shear resistance connectors. However, the manufacturing of such building components can be a relatively time-consuming and labor-intensive process, which can increase cost and lower the availability of the components.

A further significant improvement to the building component technology was developed and set forth in my pending U.S. patent application Ser. No. 09/304,221, filed May 3, 1999, which is hereby incorporated by reference in its entirety. The improved technology provides a directional, structural building component that is asymmetrical about the X-axis. The building component has an insulative core contained within an outer skin, an integral channel-shaped shear resistance connector, and integral symmetrical joinery portions with a thermal break. A face sheet may be adhered to one or both sides of the building component.

SUMMARY OF THE INVENTION

The present invention is directed toward a structural building system that overcomes drawbacks experienced by other building systems, that exhibits greater structural capacity, is easier and less expensive to manufacture and provides additional benefits over the prior art building systems. In one embodiment of the present invention, the building system is a frameless building system. The building system is used for constructing a building with a wall, a floor, and a ceiling. The system includes a plurality of composite first panels interconnected to form the walls of the building. Each of the first panels include front and back side portions positioned opposite each other, and joinery portions integral to the front and back side portions forming symmetrical joinery members. The front and back sections and the integral joinery portions define an interior area. An insulating core is in the interior area. A shear resistance connector projects from one side of the side portions into the insulating core. The adjacent first panels are joined together at the integral joinery to form a load-bearing integral post structure in the wall. A plurality of composite second panels are interconnected to form the floor or ceiling of the building. The second panels have substantially the same construction as the first panels. The adjacent second panels are joined together at the integral joinery to form an integral beam structure in the floor or ceiling. The plurality of second panels forming the floor or ceiling are connected to the first panels forming the wall so as to connect the wall to the floor or ceiling.

In another embodiment, the building system uses a plurality of asymmetrical, directional, force resisting building components interconnected to form a frameless structural panel section. In one embodiment, the building component is a panel that includes spaced apart front and back sections, an insulating core between the front and back sections, joinery members connected to the front and back sections, and at least one shear resistance connector between the front and back sections and connected to the insulating core. The front and back sections are constructed of a first material and positioned opposite each other. The front and back sections of the building component define an interior area. The insulating core is constructed of a second material different from the first material and is within the interior area for improving the panel's insulating properties without significantly adding to the panel's weight.

In one embodiment, the joinery members are symmetrical and are integrally connected to the front and back sections. The integral joinery members allows two or more building components to be bonded together to form an integral section of structural panel components, while a gap or break integral to the joinery member provides a thermal break, which substantially blocks thermal energy from passing between the inside and outside of a building structure. The structural sections resist all three primary directions of force, i.e. compressive, in-plane, and out-of-plane forces.

The building component's shear resistance connection in one embodiment is an elongated channel-shaped shear resistance connector formed as part of either the front or back section. The building component is directionally oriented such that the maximum shear force can be applied to a side of the panel opposite the shear resistance connector. The front and back sections may be further adapted to receive a face sheet cladding. The face sheet may span one or several building components, such as panels, and provides additional synergistic structural strength advantages. A single unclad panel unit provides a first level of structural strength that exhibits advantages over the prior art such as greater structural capacities at correspondingly lower weights and smaller physical sizes, all providing greater cost effectiveness than traditional building construction materials. Two or more connected panels combine to provide a second level of structural strength that has a sum strength greater than the sum of the individual panels' strengths. The addition of a face sheet spanning more than one panel and across interconnected joinery members provides a third level of structural strength that has even greater synergistic structural strength advantages as compared to the individual panels, or the unclad connected panels.

A plurality of building components are bonded together to form a freestanding frameless building. The bonded building components can be used to form the entire building system, namely, the floor, walls, ceiling and roof. In another embodiment, the bonded building components may be combined with conventional building systems, such as a conventional roof that connects to a plurality of bonded building components that form the walls, floors, and ceilings, thereby providing a freestanding, frameless building structure set on a selected foundation. In yet another embodiment, the bonded building components and conventional building components may be intermixed throughout the building system.

BRIEF DESCRIPTION OF THE DRAWINGS

FIG. 26 is an enlarged, cross-sectional view of an alternate embodiment of the door header of FIG. 24, which includes a spacer panel.

FIG. 27 is an enlarged, cross-sectional view of an alternate embodiment of a door jamb connection of FIG. 24.

FIG. 28 is an enlarged, cross-sectional view of another alternate embodiment of the door jamb connection of FIG. 24.

FIG. 29 is an enlarged, cross-sectional view taken substantially along line 29—29 of FIG. 24 showing a connection between the wall panel and a window.

FIG. 30 is an enlarged, cross-sectional view showing an alternate embodiment of the connection between the wall panel and the window of FIG. 24.

DETAILED DESCRIPTION OF THE INVENTION

Figure 1:
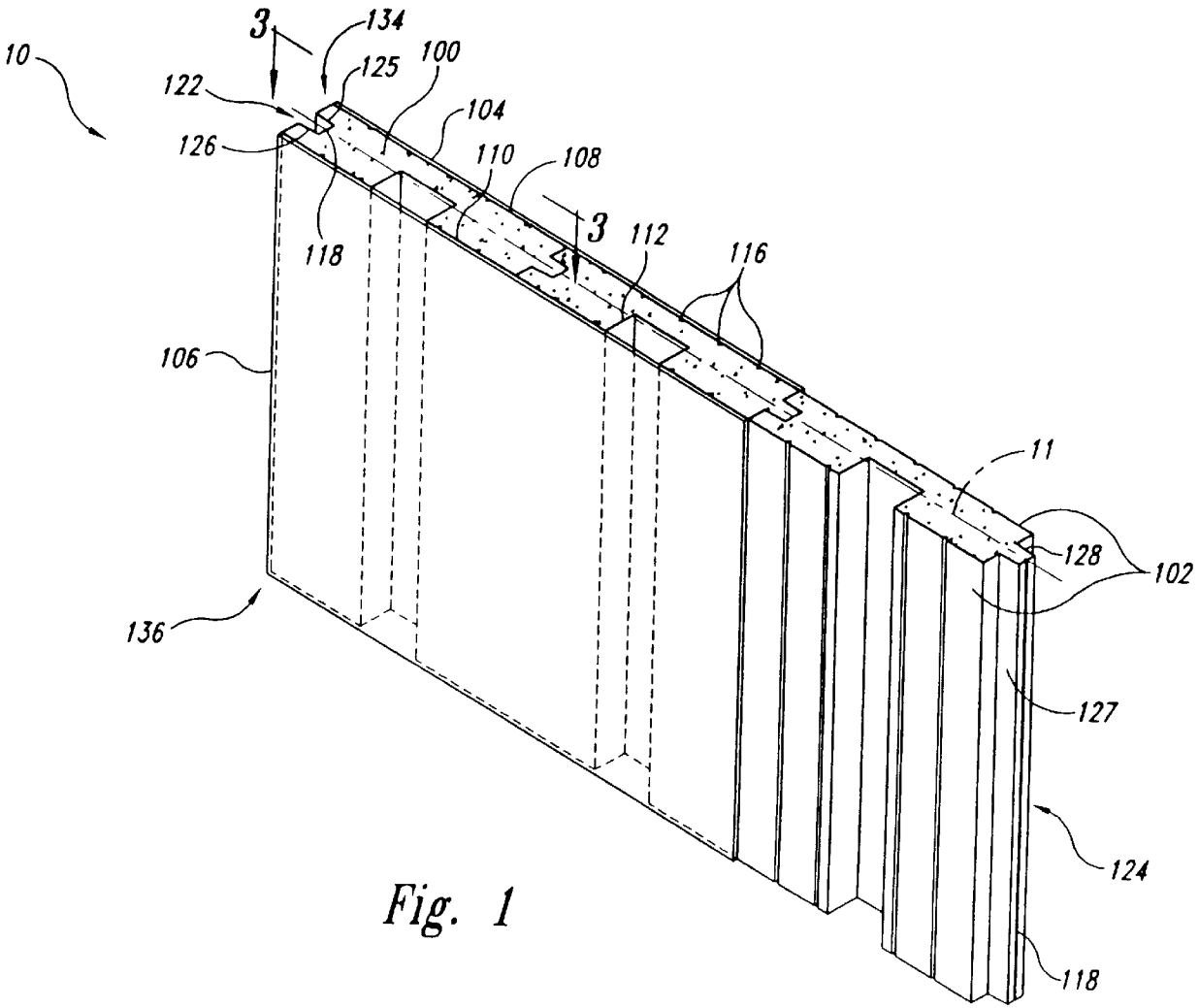
FIG. 1 is an isometric view of several assembled building panels including a face sheet spanning two of the building components, in accordance with an embodiment of the present invention.
Figure 2:
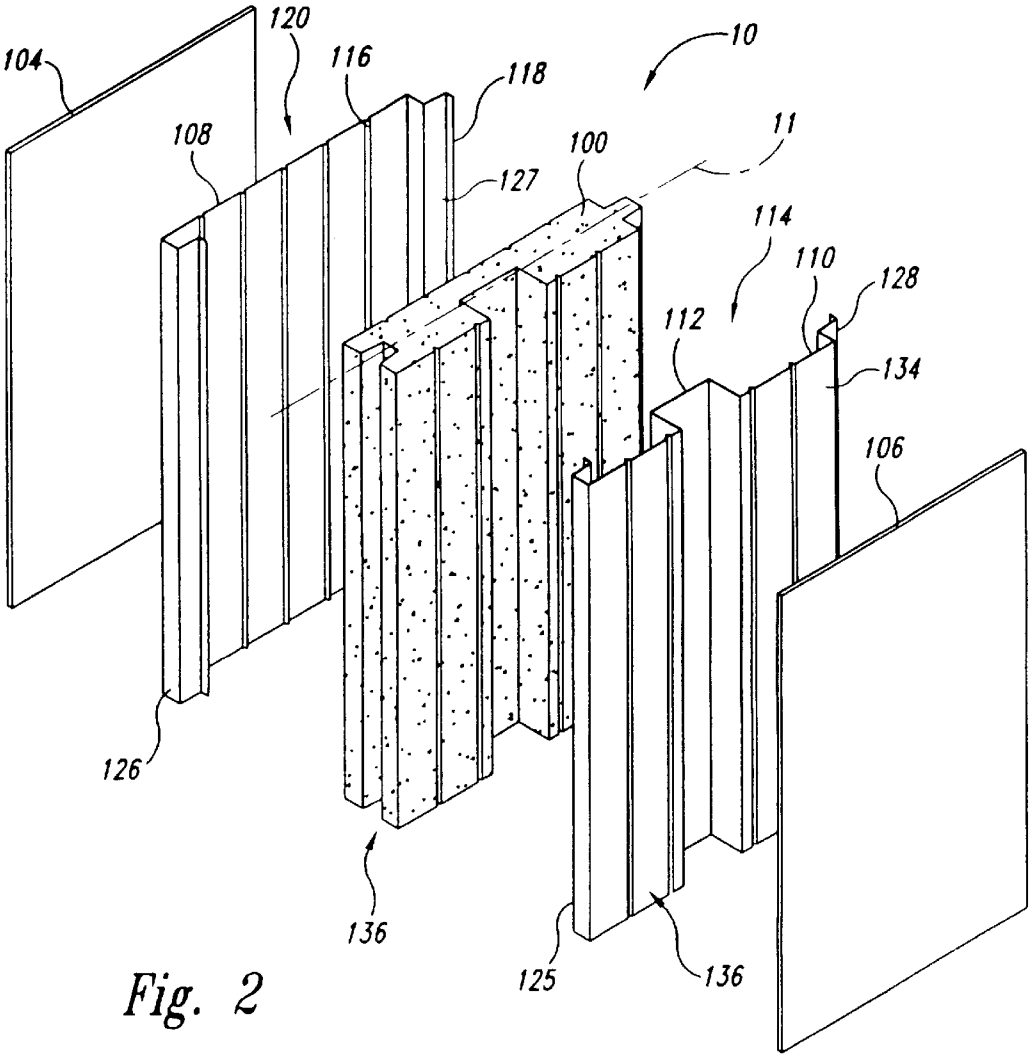
FIG. 2 is a schematic, exploded isometric view of one of the building panels of FIG. 1.
Figure 3:
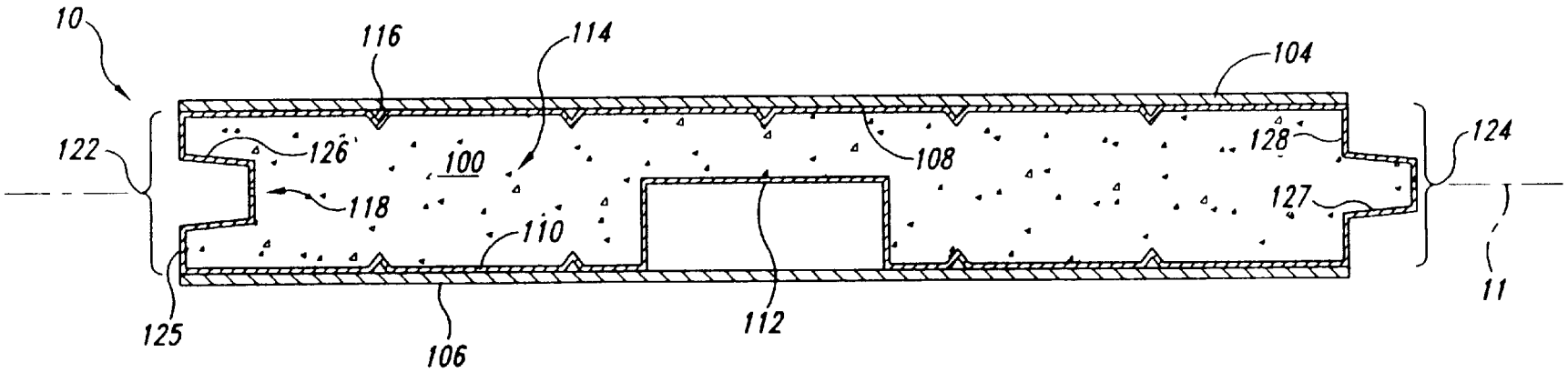
FIG. 3 is an enlarged, cross-sectional view taken substantially along line 3—3 of FIG. 1.

The present invention will be more clearly understood from the following detailed description of illustrative embodiments taken in conjunction with the attached drawings. A frameless building panel 10 in accordance with embodiments of the present invention is shown in the drawings for illustrative purposes. As shown in FIGS. 1, 2 and 3, the frameless building panel 10 in accordance one embodiment of the present invention is asymmetrical about the X-axis 11. The building panel 10 has an insulative core 100 contained within an outer skin 102. The outer skin 102 of the building panel 10 includes opposing front and back sections 108 and 110 defining an interior space 114 containing the insulating core 100. The back section 110 has an elongated integral channel-shaped shear resistance connector 112 formed therein.

The front and back sections 108 and 110 further define integral, symmetrical joinery portions 122 and 124 on the left and right sides of the building panel when viewed from the perspective shown in FIGS. 1, 2 and 3. The front and back sections 108 and 110 in the illustrated embodiment are each constructed of a thin metal film, such as 30 gauge roll-formed steel or other metal, contoured into the front or back section's final shape prior to assembly into the building panel 10 and the two being secured together as a unit by the insulating core 100. The outer skin 102 in an alternate embodiment is constructed of plastic, ceramic, and/or cementitious materials. The outer skin 102 in an alternate embodiment may be a singular section or may contain multiple sections.

When building panels 10 of the embodiment of FIGS. 1, 2 and 3 are manufactured, the front and back sections 108 and 110 are fabricated with the shear resistance connector 112, and V-shaped grooves 116 respectively, therein. A first one of the front and back sections 108 and 110 is placed in a fixture so as to provide a pan-like structure, and polyisocyanurate, polyurethane, or other expanding chemical foam is pumped into the pan-like structure in a liquid form. The chemical foam then begins to expand and the other of the front and back sections 108 and 110 is placed into the fixture on top of and secured to the first section to define the interior area 114. A spacer or blockout is used to form a thermal separator 118 (FIG. 3) between the joinery components 125 and 126 forming the grooved joinery portion 122 on the left side. A thermal separator 118 is also provided between the joinery components 127 and 128 forming the tongue joinery portion 124 on the right side. The foam expands and completely fills the interior area 114. The foam or other insulative material forming the insulative core 100 is a self-bonding material that securely bonds itself to the front and back sections 108 and 110. The bond formed by an expanding foam with the front and back sections is an extremely strong bond, so no other adhesive is needed to integrate and hold the sections together in the form of a permanently bonded, strong, lightweight building panel 10.

The front and back sections 108 and 110 are rigidly held in position by the fixture such that the expansion of an expanding foam does not force the front and back sections 108 and 110 apart during the manufacturing process. After the foam solidifies to form the insulative core 100, the insulative core 100 and the outer skin 102 are permanently and securely bonded together by an expanding foam to form a middle portion of the building panel 10. In this embodiment, the thermal separator 118, between the front and back sections 108 and 110 reduces or prevents thermal heat transfer between the front and back sections 108 and 110.

The insulative core 100 of the illustrated embodiment is a solid member constructed of cured expanded foam that has a thermal insulative value in the range of approximately 3R to 9R per inch, inclusive. In one embodiment, the building panel 10 has an insulation value up to approximately 25R. In alternative embodiments, the insulative core 100 is constructed of modified polyurethane foam, other expanding chemical foam material, or other insulative material having a thermal insulative value within the range of approximately 1R to 9R per inch, inclusively. The range of thermal insulative values of the insulating core 100 is a preferred range, although the insulating core can have a thermal insulating value that deviates from the preferred range without departing from the spirit and scope of invention.

The front and back sections 108 and 110 of the building panel 10 have different cross-sectional shapes, such that the building panel is asymmetrical about the X-axis 11. The back section 110 has an elongated, integral, channel-shaped shear resistance connector 112 formed therein. The shear resistance connector 112 defines a substantially rectangular channel 113 that extends between the top and bottom ends 134 and 136 of the building panel 10. The shear resistance connector 112 provides increased shear resistance and enhances the structural strength of the building panel 10. The side of the building panel 10 that has the shear resistance connector 112 has the ability to resist greater shear forces than a side of a panel without a shear resistance connector. The front section 108 of the illustrated embodiment has the V-shaped grooves 116 that are individual elongated shear resistance connectors that prevent localized buckling of the panel. Accordingly, the building panel 10 is directionally oriented such that a maximum shear force can be resisted when a transverse load is applied to the front section 108 of the building panel 10 opposite the back section 110 containing the shear resistance connector 112.

The substantially rectangular shear resistance connector 112 extends away from the back section 110 toward the front section 108 and terminates at a position within the interior area 114 between the front and back sections. In the illustrated embodiment, the overall panel width is approximately two feet wide, and four inches thick. The shear resistance connector 112 extends approximately 62.5% of the way across the interior area, and the shear resistance connector does not contact or engage the front section 108. The width of the substantially rectangular shear resistance connector on the illustrated embodiment is approximately 4" or approximately 16.67% of the panel's total width. The shear resistance connector in the illustrative embodiment is equidistant from the ends of the panel.

In alternate embodiments, the shear connector 112 extends across the interior area 114 within the range of approximately 35% to 100%, inclusive, of the distance between the front and back sections 108 and 110. The width of the shear resistance connector 112 in alternate embodiments may vary within the range of approximately one-twelfth to one-third of the overall panel width. The shear resistance connector 112 is securely and rigidly bonded to the insulative core 100, such that the connection along the surface of the shear resistance connector 112 adds a significant amount of strength to the building panel 10 without a significant weight increase.

The overall panel dimensions as well as the dimensions and positioning of the shear resistance connector 112 may be varied depending on the intended end use of the panel. Reducing the overall panel dimensions, for example, may increase the strength capacity of the panel unit 10, while decreasing the amount of insulation and the overall weight. Conversely, for example, increasing the overall panel dimensions may reduce the strength capacity of the building panel 10 and reduce the manufacturing and installation cost.

The front section 108 is substantially flat and has a plurality of V-shaped grooves vertically aligned and integrally formed therein. The V-shaped grooves 116 add shear structural support to the building panel 10, for example, to prevent localized buckling. The asymmetry of the panel, wherein the back section 110 has a shear resistance connector 112 and the front section 108 is substantially flat, allows the panel 10 to be oriented relative to the maximum anticipated load. The shear resistance connector 112 provides maximum shear force resistance when it is oriented away from the transverse or acting load. The building panels 10 are interchangeable for use as bearing wall panels, partition walls, floors, ceilings, or roofs. Therefore, when the building panel 10 is used as a floor or ceiling panel, for example, the front section 108 faces upwardly and the back section 110 with the shear resistance connector 112 facing downward. When the building panel 10 is used as an exterior wall panel, the front section 108 faces outwardly toward the side of the structure exposed to the outside environment.

As best seen in FIG. 3, the front and back sections 108 and 110 have the shaped joinery components 125, 126, 127, and 128 that connect to each other to form left and right integral joinery portions 122 and 124 on the left and right sides of the building panel 10. The shaped joinery components 125 and 126 on the left, as well as 127 and 128 on the right, are mirror image shapes of one another such that the completed joinery portion 122 and 124 are symmetrical about the X-axis 11. The symmetrical joinery portions 122 and 124 are tongue and groove components wherein, in the illustrative embodiment, the right side defines the tongue and the left side defines the groove. Accordingly, each joinery portion 122 and 124 is adapted to mate with a joinery portion of an adjacent building panel 10 when a plurality of adjacent building panels are interconnected to form, as an example, an interior or exterior wall. The tongue joinery portion 124 is shaped and sized to be positioned in a corresponding groove joinery portion 122 of an adjacent building panel. The connection is made between panels with an adhesive bonding material. In one embodiment, the adhesive is a polyurethane-based adhesive.

The end caps in one embodiment are elongated U-channels that connect to the top and bottom of a plurality of interconnected building panels to form a frameless structural panel section that can be used as a modular section of a wall, floor, ceiling, or roof. The structural panel section can be constructed in a factory or the like for shipment to a building site or to a warehouse for subsequent use. The structural panel sections can also be formed at the building site. The structural panel sections provide a modular panel section with selected dimensions that can be easily joined together. Accordingly, buildings can be designed by using the structural panel sections as design modules to be interconnected to form the selected wall, floor, ceiling, or roof of the building.

In the illustrated embodiment, adjacent edge portions of the front and back sections 108 and 110 are spaced apart from each other by a gap, and the thermal separator 118 is positioned in the gap. Accordingly, each of the left and right joinery portions 122 and 124 include a thermal break that separates the front and back sections 108 and 110. The thermal break reduces the transfer of heat between front and back sections 108 and 110 of the building panel 10, thereby increasing the panel's effective insulation value.

The illustrated building panel 10 is a non-combustible panel with a high insulative factor as discussed above. The building panel 10 constructed as illustrated further provides a panel that is rot and insect resistant as well as substantially water impermeable. Additionally, when placed under an extreme load, the building panel 10 bends as opposed to breaking, and substantially recovers from large transverse deflections after removal of the loads. This ability of the structural component to bend and recover from load deflections allows the component to be effective in resisting and recovering from seismic and wind loads.

In the illustrated embodiment of FIGS. 1, 2 and 3, the top and bottom ends 134 and 136 of the building panel 10 are open such that the insulative core 100 is exposed prior to installation of the building panel 10. When the building panel 10 is used as a wall panel, the top and bottom portions 134 and 136 are adapted to fit within conventional elongated top and bottom U-channels, respectively. Accordingly, the U-channels are end caps on the top and bottom portions 134 and 136 of building panels 10.

In one embodiment, separate end caps, which are made from 16 gauge steel bent into a channel shape with approximately 2" flanges and a web depth approximately 1/16" larger than the nominal panel thickness, are secured (e.g., bonded and screwed) onto the top and bottom portions 134 and 136 of each building panel 10. These end caps serve to protect the ends of the building panels from local damages and provide connecting hardware by which the building panels are connected to adjacent building panels, foundations, roofs, or intermediate floors.

In another alternate embodiment, not illustrated, the top and bottom portions 134 and 136 are fully closed with caps integral to the front and back sections 108 and 110, such that the insulative core 100 is not exposed. In this alternate embodiment, a thermal break is provided between the front and back sections at the top and bottom portion. In yet another alternate embodiment, the front and back sections 108 and 110 are formed such that the joinery portions 122 and 124 are provided along the sides and joinery portions are also provided along the top and bottom ends 134 and 136 of the building panel 10. Accordingly, as the building panels 10 are connected together, for example, during construction of a multi-story building structure, the joinery portions along the top, bottom, left and right sides of each building panel form a junction between adjacent building panels. Adjacent building panels 10 are secured together, as an example, with an adhesive bonding material and/or conventional fasteners.

The assembled structural panel 10 is an extremely resilient, load-bearing structural component having a high strength-to-weight ratio. In one embodiment in which the structural panel 10 is a two foot wide, eight feet long, and four inches thick, the building panel 10 is extremely resistant to bending, shear, tension and compression forces in all directions relative to the panel at commercial building code levels. The building panels 10 of the illustrated embodiment have been certified as exceeding building permit requirements to levels of force resistance with respect to all those primary directions of force as tested in accordance with ASTM Standard E72 of compression, in-plane, transverse and lift loads. Accordingly, the building panels 10 far exceed the requirements for use in construction of commercial buildings.

In at least one certification test, the building panel 10 withstood the equivalent of Hurricane V wind forces. In addition, the strength-to-weight ratio of the structural panel 10 is at least 33 to 1. This means that one pound of panel 10 is capable of supporting 33 pounds of load. The panel 10 meets this minimum strength-to-weight ratio regardless of whether the loading is transverse or axial. In another embodiment, testing demonstrates that the panel 10 has a strength-to-weight ratio of approximately 44 to 1 for transverse load, and approximately 127 to 1 for an axial load. In a certification test in accordance with ASTM E72 testing procedure for Distributed load and Point-load of unsupported assemblies, the building panel withstood a 9000 lbs. Point-load/136 lbs. weight of panel section, thereby providing approximately a 66 to 1 strength-to-weight ratio when point loaded. The building panel also withstood 14,000 lbs. Distributed load per 136 lbs. weight of panel section, thereby providing approximately a 103 to 1 strength-to-weight ratio for Distributed loads. The building panel 10 also withstood a 150 lbs./sq. ft. floor load rating on a 7 lbs./sq. ft. of floor weight (w/cladding), thereby providing a floor load support of approximately 21.4 to 1 for one square foot of floor. Accordingly, the building panels 10 can be extremely light weight while maintaining high strength, which greatly increases the ease of handling the building panels, for example, during construction of a building.

Combining the panels 10 together creates a second level of synergistic strength. The first level of strength is the building panel 10 itself. The building panel 10 exhibits greater structural-load-bearing capacity than non-load bearing panels that are on the market. Connecting two or more panels provides a second level of strength greater than simply the sum of the panel's individual strengths. This synergistic composite strength results in a stronger building system when the building panels 10 are combined to form a freestanding, frameless, load bearing wall, roof, and floor or ceiling section. A third synergistic strength relationship is created when a face sheet is laminated to the surface of a single building panel. Yet a fourth level of strength is created when a face sheet is laminated to the surface of two or more adjacent building panels 10 and across the joint between the adjacent panels.

In an alternate embodiment, only one of the front or back face sheets 104 and 106 is adhered to the outer skin 102 before the building panel 10 is shipped to a construction site. The building panels 10 with the single face sheet are joined together at the construction site, and the other of the front or back face sheets 104 and 106, is then added to the building panel. The face sheet added at the construction site in accordance with the specification of the construction project can be added to the building panels in an efficient and timely manner, thereby resulting in a completed building that utilizes the beneficial characteristics of the building panel 10.

In the illustrative embodiment of FIG. 1, the building panel 10 is clad in face sheets 104 and 106. The front and back face sheets 104 and 106 may be adhered to the front and back sections 108 and 110 of the outer skin 102. In the embodiment illustrated in FIG. 1, the front and back face sheets 104 and 106 are adhered to the outer skin 102 by an adhesive layer. The bond provided between the outer skin 102 and the face sheet 104 or 106 has a sufficient strength to remain on the building panel 10 during the anticipated loading conditions. In another embodiment, the front and back face sheets 104 and 106 are adhered to the outer skin with an adhesive layer.

The face sheets 104 and 106 shown in FIG. 1 span across at least two building panels 10, thus tying the individual building panels together to create the synergistic strength relationship. This relationship results in a composite system that has a greater overall strength than the individual strengths of the system's components. In alternative embodiments, the face sheet 104 or 106 spans one or more of the individual building panels 10. Further, the joint of adjacent face sheets 104 or 106 may be staggered with respect to the joint between the building panels 10. The face sheet 104 or 106 in alternate embodiments is constructed of plastic, metal, ceramic and/or cementitious materials.

Figure 4:
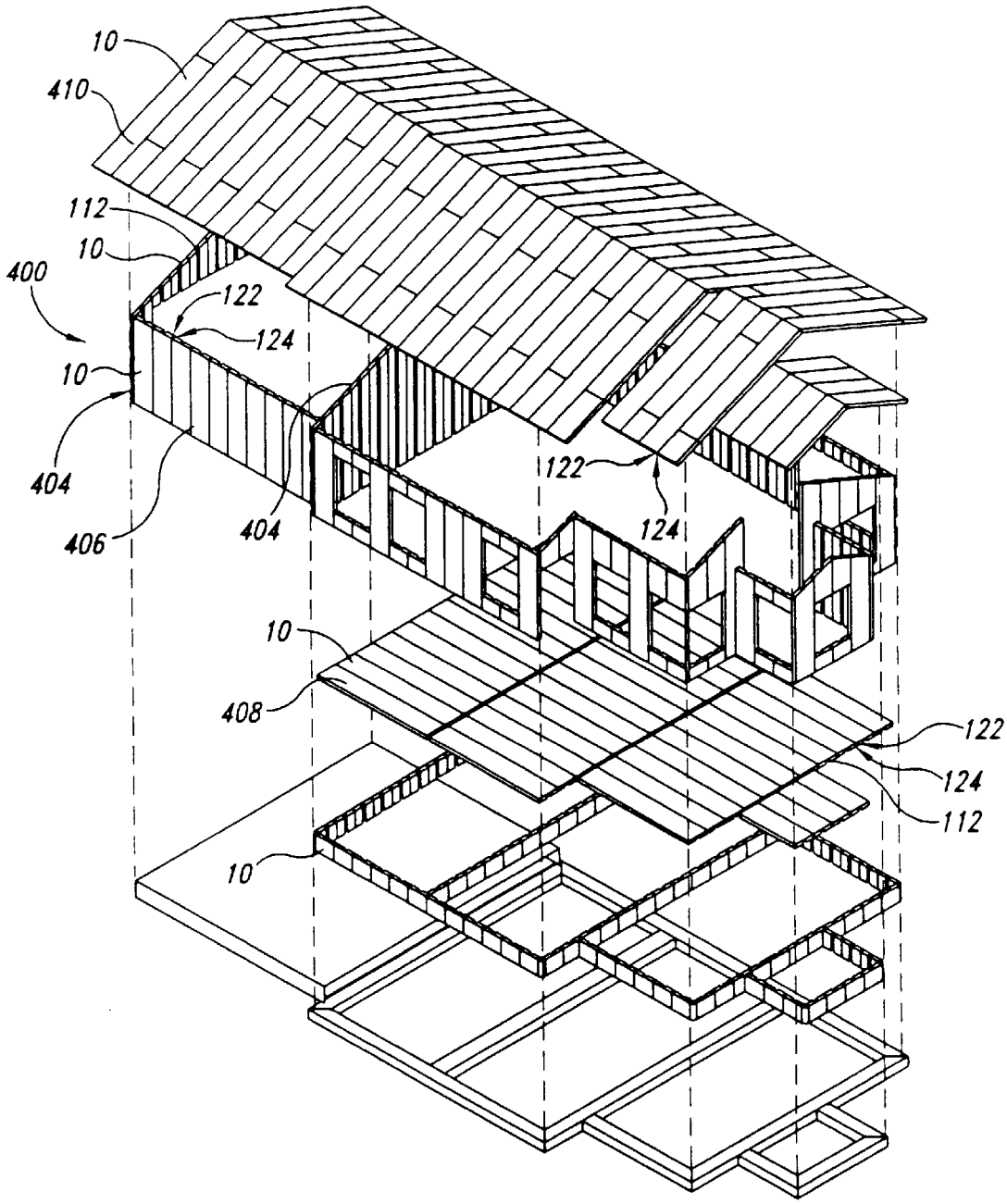
FIG. 4 is an exploded isometric view of a building system constructed with the panels of FIG. 1.
Figure 5:
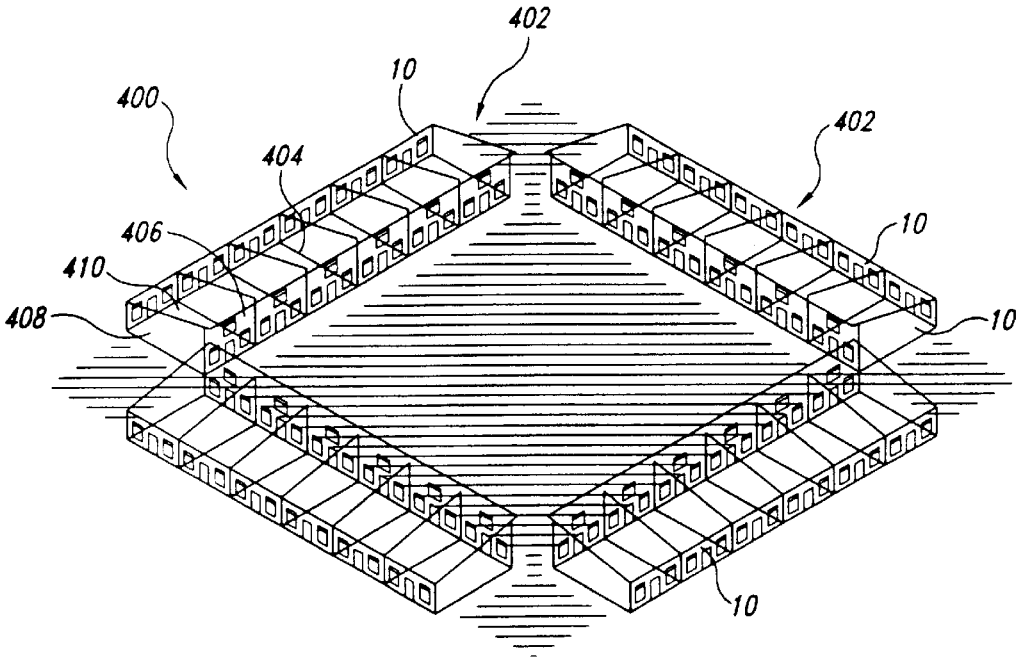
FIG. 5 is a reduced, isometric view of another building system constructed from the building panels of FIG. 1.

FIGS. 4 and 5 illustrate two embodiments of a building system 400 constructed of a plurality of frameless building structures 402, including interior walls 404, exterior walls 406, floors/ceilings 408, and roofs 410. The building structures 402 of this embodiment are all constructed with a plurality of the interconnected building panels 10. To form the frameless building structures 402, adjacent building panels 10 having the same construction are bonded together along the symmetrical joinery 122 and 124 as discussed above to form the respective internal and external walls, floors, ceilings, and/or roof. The symmetrical joinery 122 and 124 can be bonded together with an adhesive bonding or other similar materials, or can be securely connected by conventional fasteners or the like. When the building panels 10 are vertically oriented and joined together to from an interior or exterior wall 404 or 406, the bonded joinery 122 and 124 of adjacent building panels 10 forms an internal, integral post structure in the wall. When the building panels 10 are horizontally oriented to form a ceiling or a floor 410, the interconnected joinery 122 and 124 form an internal integral beam. The interconnected panels 10 with the integral post or beam structures combined with the strength of each load bearing, structural panel itself, provides a the freestanding, frameless building structure.

The building structure 402, once completed, is typically subjected to a variety of loads externally as well as internally. These loads can include wind loads and seismic loads.

The loads can also include point loads or distributed loads, such as on the floor panels from people or equipment on the building's floors. These loads and direction of the forces acting on the building panels can generally be anticipated when designing the building structure. When constructing the building structure 402 with the building panels 10, the building panels 10 are directionally oriented with respect to the anticipated loads so the shear resistance connector 112 is oriented away from the transverse or acting load to provide maximum shear force resistance to the load. Therefore, when the building panel 10 is used as a floor/ceiling panel 408, roof panel 410, the panel 10 is positioned such that the open channel 113 of the shear resistance connector 112 faces downwardly to achieve maximum shear force resistance. When the building panel 10 is used as an exterior wall panel 406, the shear resistance connector 112 faces toward the interior of the building structure 402 to achieve maximum shear force resistance to, as an example, wind or seismic loads.

If an anticipated maximum shear force that the building panel 10 is required to resist is less than a capacity for the side of the building panel opposite the shear resistance connector 112, and then the building panels may be oriented without respect to force. In this situation, concerns such as aesthetics or utility will effect building panel 10 orientation. For example, for an exposed interior wall 404, the building panel 10 may be selectively oriented relative to a room within the building, so the shear resistance connector 112 provides a raceway for wiring, or plumbing for the room. When floor/ceiling panels are supported on a floor beam because of an elongated, span distance, the floor/ceiling-building panels may be oriented with the flat side of the building panel's facing the beam, and the shear resistance connectors 112 facing upwardly. Accordingly, connecting bolts that fasten the building panels 10 to the beams can be sunk in the bottom of the shear resistance connector 112, through the building panel and into the beam. A flooring deck can then be installed directly on top of the floor/ceiling building panels without interference from protruding heads of the connecting bolts.

Figure 6:
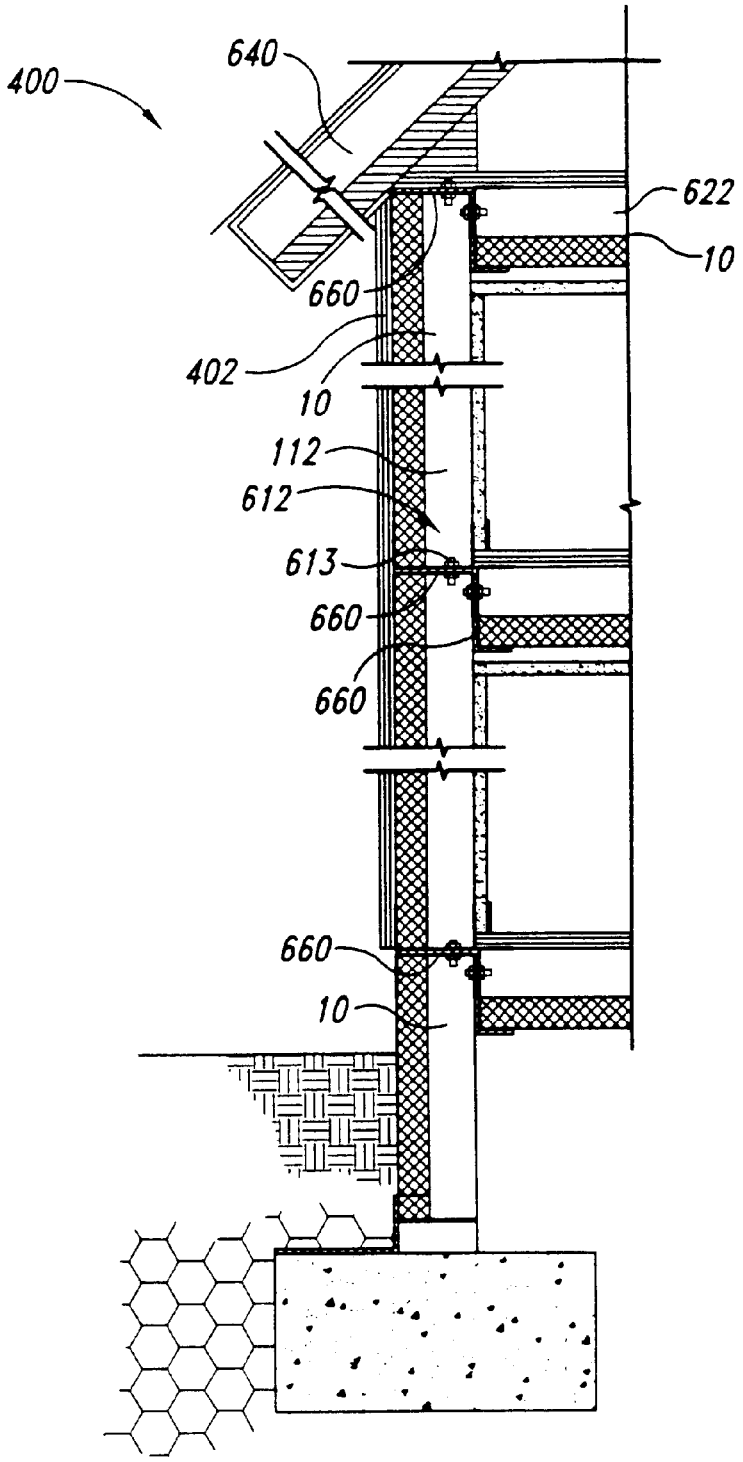
FIG. 6 is a partial cross-sectional view showing exterior wall panels, floor/ceiling panels, and roof connections of a multiple-story building in accordance with an embodiment of the present invention.
Figure 7:
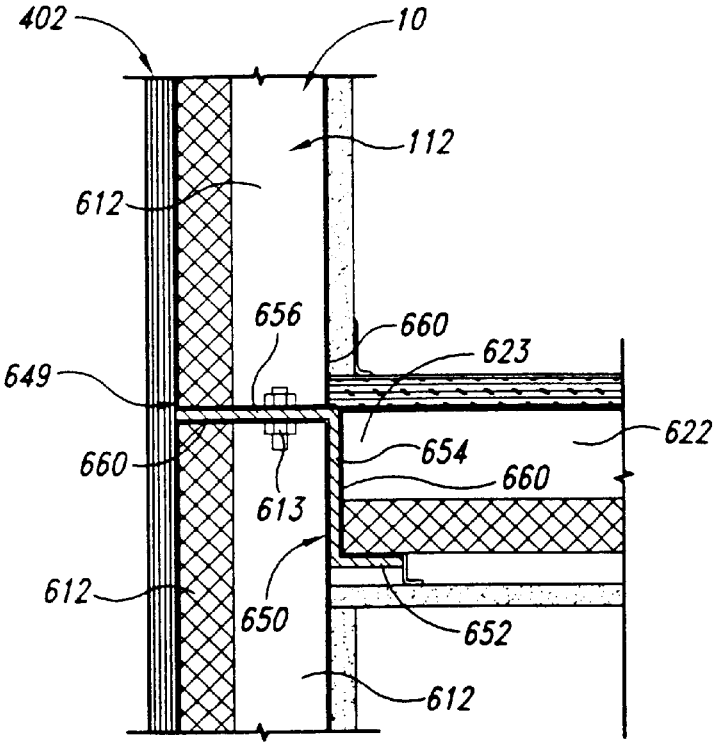
FIG. 7 is an enlarged, cross-sectional view of a connection between the wall panels and the abutting floor/ceiling panel of FIG. 6.
Figure 8:
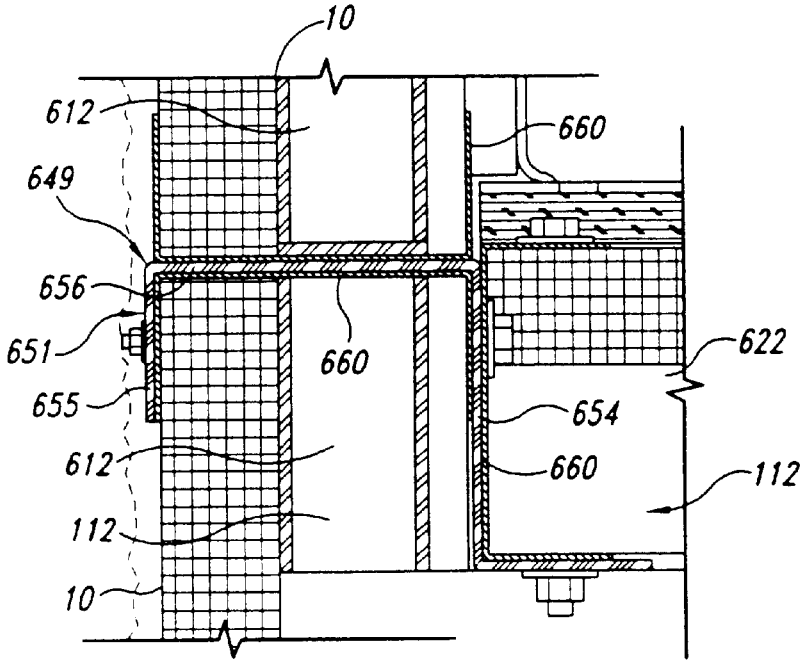
FIG. 8 is an enlarged cross-sectional view of a floor hanger bracket of an alternate embodiment of the invention.

FIG. 6 is a cross-sectional view illustrating connections between a plurality of the building panels 10 interconnected to form exterior wall panels 612, floor/ceiling panels 622 and roof panels 640 in one embodiment of the building system 400. FIGS. 7 and 8 illustrate a cross-sectional view of the interconnections between two vertically aligned wall panels 612 atop one another and an abutting horizontal floor/ceiling panel 622.

The wall panels 612 have upper and lower end caps 660, such as metal U-channels, connected to a respective top or bottom of the building panel 10 to protect the end and to provide connecting hardware. In the embodiment discussed above wherein the end caps 660 extend across several interconnected panels, the end caps work to tie the interconnected panels together to form the structural panel section. The end caps 660 may include predrilled bolt holes to facilitate connection and assembly when connecting building panels. The predrilled bolt holes are aligned with the channel 113 formed by the shear resistance connectors 112, so the bolt holes are accessible from the top and bottom sides of the end cap. The wall panels 612 are secured together with a plurality of bolts 613 (FIG. 6) extending through the end caps 660. Alternatively, the building panel's ends may be connected together with integral symmetrical joinery 122, 124, as previously described with respect to FIGS. 1, 2 and 3. The symmetrical joinery 122, 124 can be used along any of the panels' connecting edges such that the symmetrical joinery of the two adjacent panels mate to form a connection between the building panels.

As shown in FIGS. 7 and 8, the abutting floor/ceiling panel 622 forming a structural floor/ceiling panel section connects to the exterior wall panels 612 forming a structural wall panel section with a hanger assembly 649 bolted to the panels. End caps 660 are bonded to ends of the floor/ceiling panel 622 abut the wall panels 612. These end caps 660 provide connecting hardware to bolt into. In the embodiment of FIG. 7, the hanger assembly 649 is a "Z" plate 650 that interconnects the vertical wall panels and horizontal floor/ceiling panel. A horizontal lower leg 652 of the "Z" plate 650 supports an end 623 of the floor/ceiling panel 622 adjacent to the wall panels 612. The "Z" plate 650 is positioned such that a horizontal top leg 656 of the "Z" plate 650 is sandwiched between the lower exterior panel's end cap 660 and the upper exterior panel's end cap. A vertical middle leg 654 of the "Z" plate extends between an interior side of the lower wall panel 612 and the end cap 660 of the floor/ceiling panel. The end cap 660 of the floor/ceiling panel 622 is bolted to the middle leg 654 of the "Z" plate 650. In the embodiment illustrated in FIG. 8, the hanger assembly 649 is similar to the "Z" plate described above, except the hanger assembly has a cap portion 651 formed by the upper leg 656, the vertical middle leg 654, and another vertical outer leg 655 spaced apart from the middle leg, so the cap portion extends over the end cap 660 of the lower wall panel 612. The floor/ceiling panel 622 is supported by a horizontal lower leg 652 of this hanger assembly. The hanger assembly 649 is bolted to the top of the lower wall panel 612 and to the adjacent end of the floor/ceiling panel 622.

The bolted connections illustrated in FIGS. 7 and 8 have the advantage of allowing connections between the top of the wall panels 612 and the floor/ceiling panel 622 wherever is convenient or desired along the length of the wall. Further, the building panel 10 can be cut in the field to the exact measurements needed and then an end cap 660 can be bonded in place to ensure dimensional accuracy of the building panel. Additionally, the illustrated embodiments utilize conventional, easy-to-procure connecting hardware. Further, the ability to connect floor/ceiling panels 622 to the top of the wall panels 612 with ease at virtually any position along the length of the resulting wall provides flexibility for changes in the field if needed as well as accommodating unique design configurations. These features thus provide advantages both with respect to ease of material procurement, assembly, and panel manufacturing.

Figure 9:
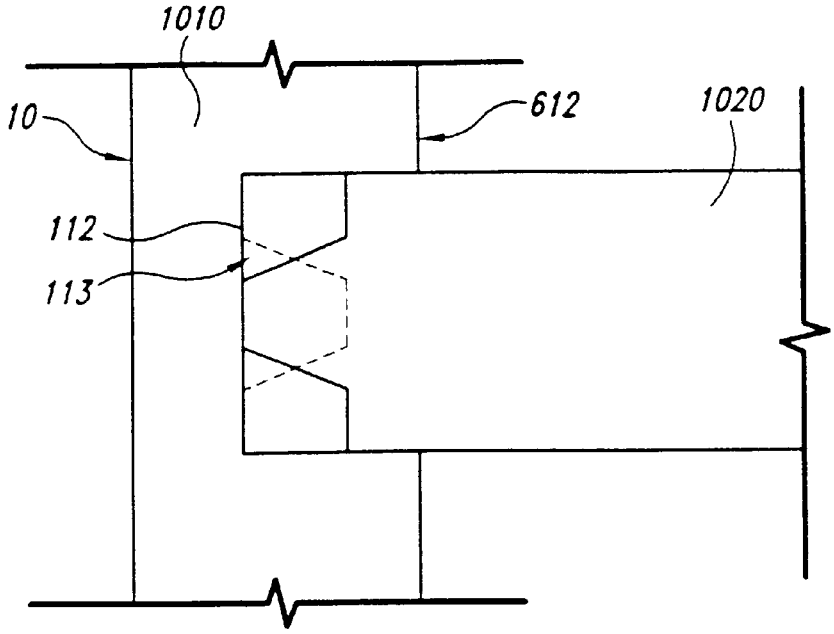
FIG. 9 is an enlarged, plan view of a connection between interior wall panels in the building system of FIG. 4.
Figure 10:
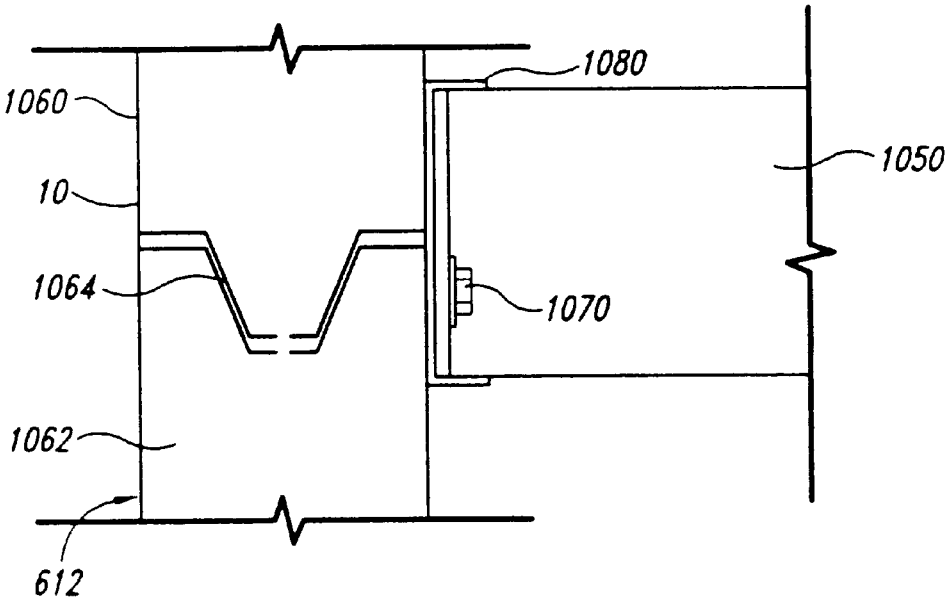
FIG. 10 is an enlarged, plan view of another connection between interior wall panels in the building system of FIG. 4.

FIGS. 9 and 10 illustrates plan views of two embodiments of a connection between a plurality of the building panels 10 that form intersecting walls. In the embodiment illustrated in FIG. 9, a first interior wall panel 1010 abuts a second wall panel 1020 at the second wall panel's shear resistance connector 112. The first interior wall panel 1010 has a thickness slightly smaller than the width of the channel 113 formed by the shear resistance connector 112. The end of the first wall panel 1010 extends into the channel 113 as shown and is adhered with a selected adhesive to the second interior wall panel 1020 within the shear resistance connector 112.

In the embodiment of FIG. 10, a first interior wall panel 1050 is connected to a pair of adjacent coplanar second wall panels 1060, 1062 at the wall joint 1064 therebetween. Accordingly, the first wall panel 1050 is perpendicular to the second wall panels 1060, 1062. In this embodiment, the first wall panel 1050 is positioned so the panel's groove-side joinery is adjacent to the second wall panels 1060, 1062. Alternatively, the tongue-side joinery of the first wall panel 1050 is cut off of the wall panel to provide a flat abutting surface connected to the second wall panels 1060, 1062. A U-channel endplate 1080 on the end of the first wall panel 1050 is adjacent to the second wall panels 1060, 1062 and is connected to the second wall panels with a self tapping screw 1070 extending into the endplate and through the wall joint 1064 between the second wall panels. The endplate 1080 can be glued, screwed, bolted, or otherwise secured to the end of the first wall panel 1050 prior to securing the endplate to the second wall panels 1060, 1062 at the wall joint 1064.

FIGS. 9 and 10 further illustrate the versatility of this building system. If a building is designed such that a wall panel 612 perpendicularly intersects another wall panel at the shear resistance connector, then the intersecting wall panels can be bonded together to make the connection with no additional connecting hardware. Alternatively, connections can readily be made with the end caps 660 or other similar hardware to accommodate unique wall designs.

Figure 11:
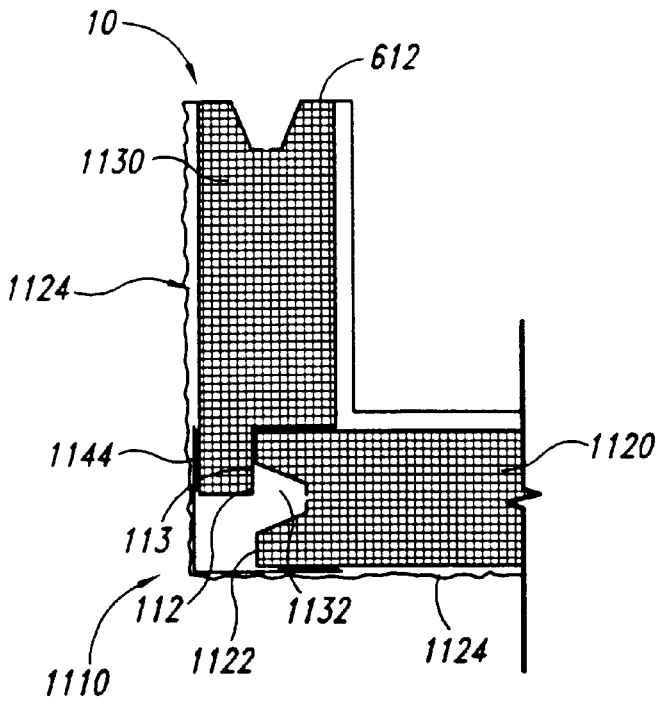
FIG. 11 is an enlarged, plan view of a corner connection between two wall panels in the building system of FIG. 4.

FIG. 11 illustrates one embodiment of a corner connection 1110 between two wall panels 1120, 1130. A flat end 1122 of the first wall panel 1120 is adhered to the second wall panel 1130 in the channel 113 of the shear resistance connector 112. In the illustrated embodiment, the second wall panel 1130 is cut approximately in half, through a portion of the shear resistance connector 112 to form a receiving notch 1132 for the first wall panel 1120. Accordingly, the second wall panel 1130 terminates adjacent to one end of the shear resistance connector 112, so a side and a bottom of the substantially channel-shaped shear resistance connector remains integral to the second wall panel. The second wall panel 1130 can be cut in the field, at the factory, or other remote location to form the notch 1132.

An "L" shaped corner bracket 1140 is positioned at the perpendicular connection of the first and second wall panels 1120, 1130 such that a first leg 1142 of the corner bracket 1140 is connected to an exterior surface 1124 of the first wall panel 1120. A second leg 1144 of the corner bracket 1140 is connected to an exterior surface 1124 of the second wall panel 1130. The corner bracket 1140 provides both aesthetic continuity along converging exterior lines of the wall panels, as well as protecting the ends of the first and second wall panels 1120, 1130 from being damaged.

Figure 12:
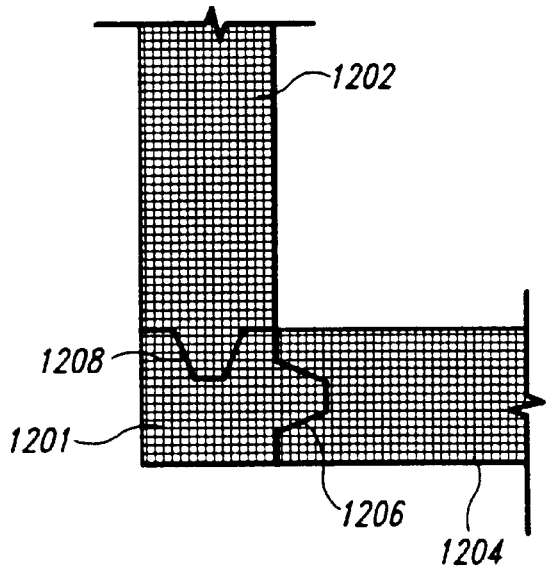
FIG. 12 is an enlarged cross-sectional view of an alternate corner connection between two wall panels with a corner post therebetween.

As best seen in FIG. 12, an alternate embodiment provides a contoured composite corner post 1201 that interconnects two perpendicularly oriented wall panels 1202, 1204. The corner post 1201 has integral tongue joinery 1206 and groove joinery, 1208 oriented at approximately 90 degrees relative to each other. The groove joinery 1208 in the corner post 1201 mates with and is adhered to the tongue joinery of the first wall panel 1202. The tongue joinery 1206 of the corner post 1201 mates with and adheres to the groove joinery in the second wall panel 1204. In the illustrated embodiment, the corner post 1201 is constructed in a manner similar to that of the wall panels 1202, 1204 with outer metal skin members that contain a insulative foam core. The joinery portions 1206, 1208 also have thermal breaks therein to enhance the thermal resistance and insulative properties of the wall panels 1202, 1204 and corner posts 1201. In another embodiment, a corner post 1201 can be provided having the joinery oriented at different angles relative to each other so as to provide a corner that is at angles other than 90 degrees, such as an acute corner angle or an obtuse corner angle.

Figure 13:
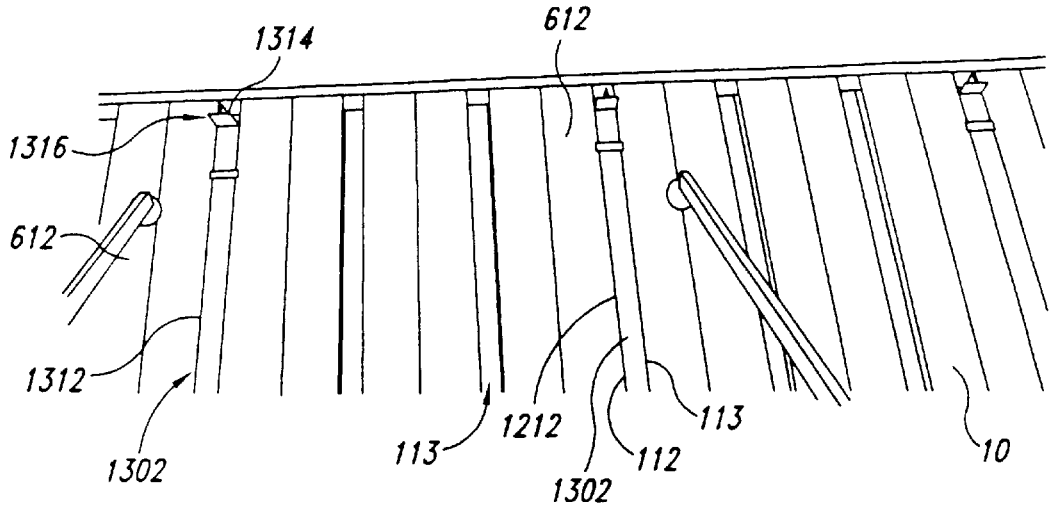
FIG. 13 is an enlarged isometric view of a plurality of wall panels of FIG. 1 with joist supports retained in the shear resistance connector of every third wall panel.
Figure 14:
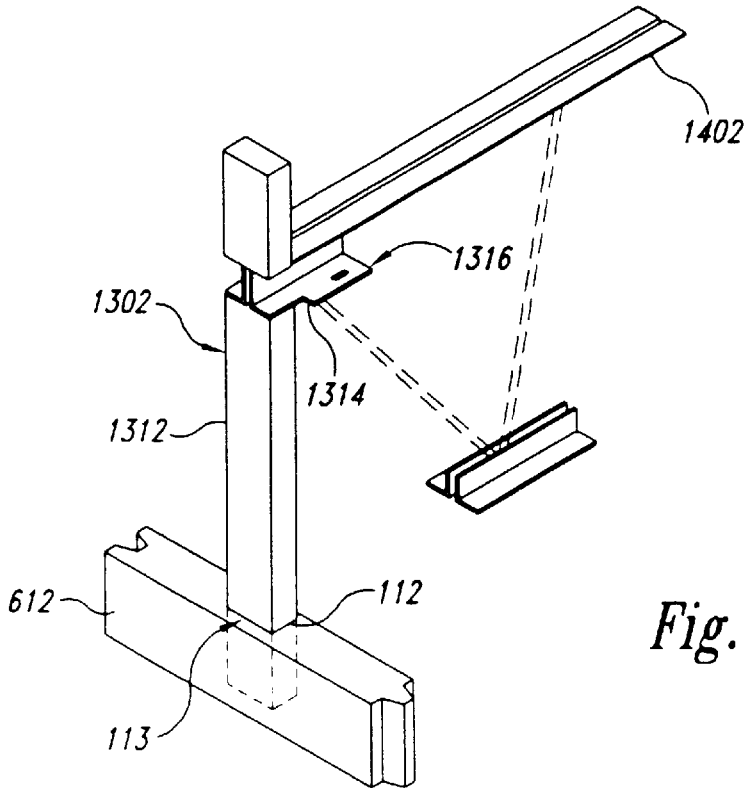
FIG. 14 is a partial cut-away isometric view showing a floor joist supported on the joist support of FIG. 13, with a portion of a wall panel cut away for purposes of clarity.
Figure 15:
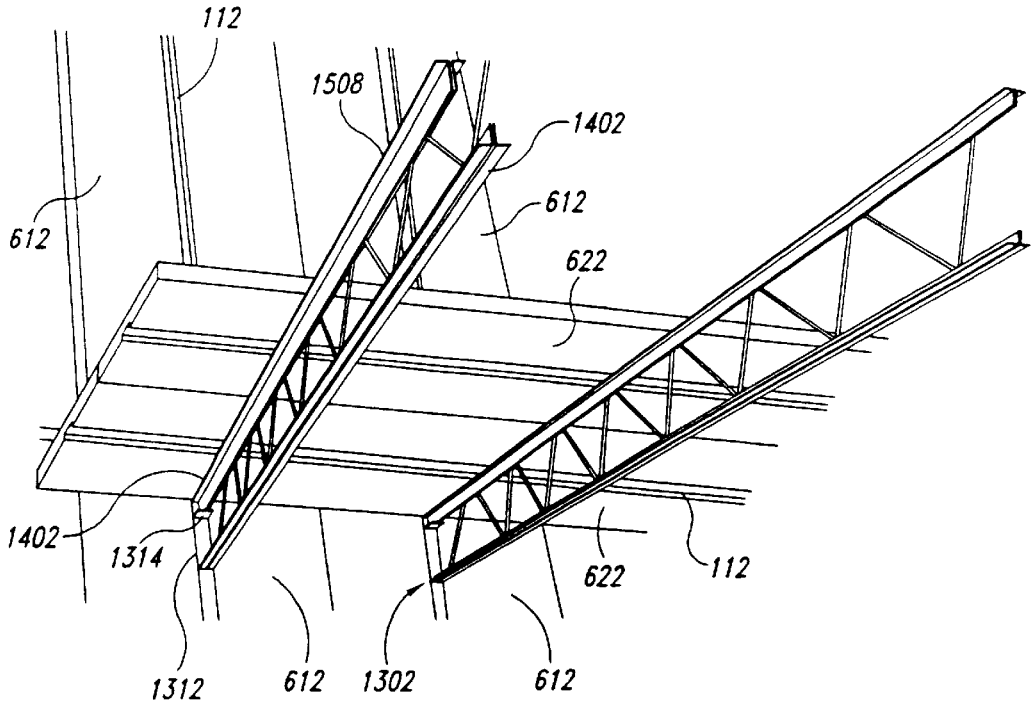
FIG. 15 is a partial isometric view showing a plurality of floor/ceiling panels mounted or connected to the wall panels and attached to the floor joists of FIG. 14.

FIG. 13 illustrates a plurality of exterior wall panels 612 of one embodiment in a partially constructed configuration with a plurality of joist supports 1302 nested in the channels 113 formed by the shear resistance connectors 112 in the wall panels. FIG. 14 illustrates the joist supports 1302 nested in the wall panel 612, with the wall panel being shown partially cut-away and the floor joist 1402 is mounted on the joist support. FIG. 15 is an isometric view illustrating the wall panels 612, joist supports 1202, floor joists 1402, and floor/ceiling panels 622 positioned on the floor joists and connected to the walls. In FIG. 15, one of the floor/ceiling panels 622 is shown in a raised position during construction before being placed onto the floor joist 1402 and secured into position. The joist support 1302 has an elongated member with a cross-sectional shape slightly smaller than the dimensions of the channel 113 formed by the shear resistance connector 112. In one embodiment, the joist support 1302 is adhered to the wall panel 612, and in alternate embodiments, the joist support 1302 is fastened to the wall panel with conventional fasteners. In the illustrated embodiment, joist supports are nested in every third wall panel 612 to provide a selected distribution along the exterior wall. Alternate embodiments can have other distribution patterns for the joist supports 1302.

The joist support 1302 has a post portion 1312 that connects at its bottom end into a "U" channel or other structure to which the wall panel's bottom end is attached. The upper end of the post portion 1312 terminates slightly below the upper end of the wall panel 612. A flat joist plate 1314 is attached to the top of the post portion 1312 and projects outwardly from the wall panel 612 to provide a flat mounting surface 1316.

As best seen in FIGS. 14 and 15, the joist plate 1314 is fastened to the elongated floor joist 1402 that extends horizontally away from the joist support 1302. The floor joist 1402 is used for buildings in which the span between the wall panels is substantial. The floor joist 1402 in the illustrated embodiment supports a plurality of floor/ceiling panels 622 interconnected to each other and to the wall panels 612, as discussed above. The floor/ceiling panels 622 are positioned on the floor joists 1402 such that the shear resistance connectors 112 are perpendicularly oriented relative to the floor joists. In this embodiment, the building structure is a multi-story building. The floor/ceiling panels 622 form the floor of an upper floor. Accordingly, point loads and distributed loads will be applied to the top side of the floor/ceiling panels 622, for example, from people and equipment on the floor, Accordingly, the floor/ceiling panels 622, as illustrated, are oriented so the shear resistance connectors 112 are facing downwardly away from the anticipated applied loads.

In alternate embodiments wherein the span between wall panels 612 is smaller, the floor joists 1402 and joist supports 1302 are not needed. Accordingly, the floor/ceiling panels 622 are connected to the wall panels and unsupported across the span except by the internal, integral beams formed by the joinery 122, 124.

Figure 16:
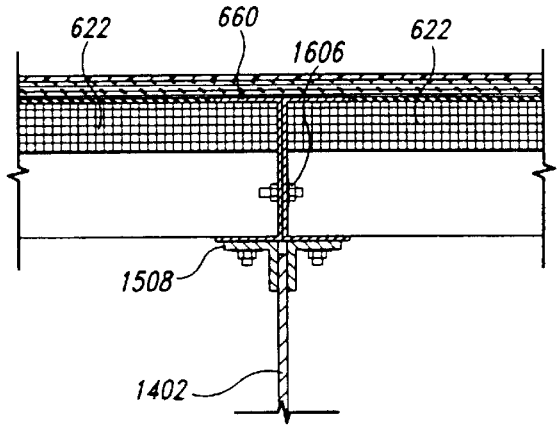
FIG. 16 is an enlarged cross-sectional view taken substantially along lines 16—16 of FIG. 14 showing the floor/ceiling panels connected to the floor joist.

FIG. 16 is a cross-sectional view illustrating a pair of floor/ceiling panels 622 secured together at their ends, and attached to the floor joist 1402. The floor/ceiling panels 622 are positioned end-to-end, so these "U" channel end caps 660 abut the end cap of the adjacent panel. Accordingly, the floor/ceiling panels are positioned so the internal, integral beams formed by the joinery 122, 124 (FIG. 1) of the adjacent panels are perpendicular to the floor joists 1402. The floor/ceiling panels 622 are connected together by bolts 1606 that extend through the abutted end caps 660. The floor/ceiling panels 622 are also bolted to the mounting surface 1508 of the floor joist 1402 so as to securely retain the floor/ceiling panels in place. In alternate embodiments, the floor/ceiling panels 622 can be joined together by integral joinery or other connection mechanisms. Similarly, the floor/ceiling panels 622 can be connected to the floor joists with hardware other than bolts.

Figure 17:
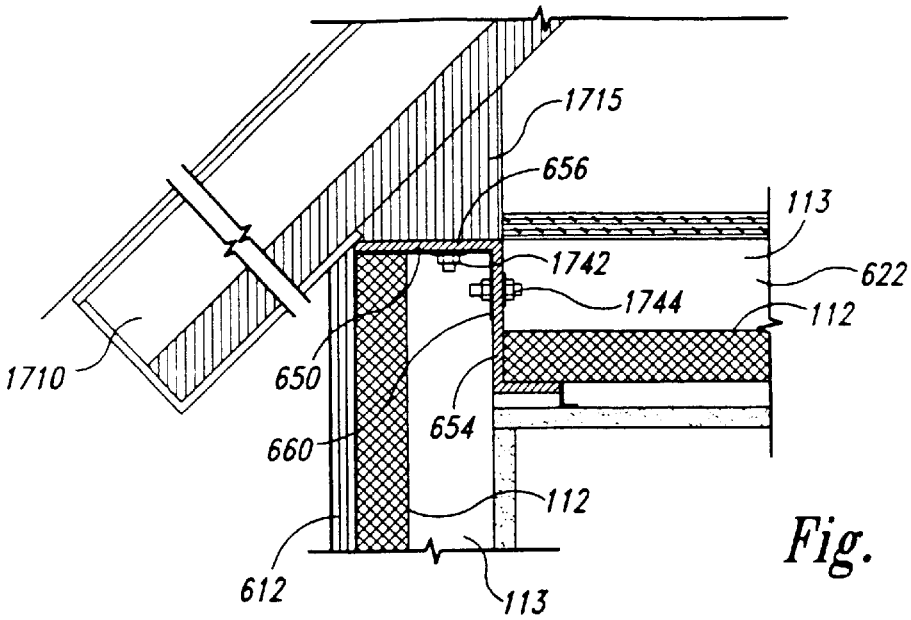
FIG. 17 is an enlarged, cross-sectional view of connections between the exterior wall panel, a floor/ceiling panel, and a roof panel of FIG. 4.

FIG. 17 illustrates one embodiment of an interconnection between an exterior wall panel 612, a roof panel 1710, and a floor/ceiling panel 622. An end cap 660 or similar connecting hardware is connected to the ends of the wall panels 612 to form a structural wall panel section and the floor/ceiling panels 622 to form a structural floor/ceiling panel section. The structural floor/ceiling panel section is connected to the structural wall panel section with the "Z" plate 650 or other hanger assemblies, as discussed above. The upper leg 656 of the "Z" plate 650 is sandwiched between a bottom side of a continuous wedge 1715 attached to a bottom side of the roof panel 1710 and the end cap 660 of the wall panel 612. The continuous wedge 1715 is bonded or attached with conventional fasteners to a bottom side of the roof panel 1710. The continuous wedge 1715 provides a relatively flat support surface beneath a sloped surface of the roof panel 1710 to allow connection to the wall panels 612. A bolt 1742 is installed through the end cap 660 of the wall panel 612, through the upper leg 656 of the "Z" plate 650 and into the wedge 1715. The middle leg 654 of the "Z" plate 650 abuts the end cap 660 of the floor/ceiling panel 622 and a bolt 1744 secures the middle leg 654 to the panels' end cap.

In the illustrated embodiment, the roof panels 1710 are oriented with the channels 113 formed by the shear resistance connectors 112 facing upwardly. Face sheets or other selected cover material, such as a roofing substrate, is attached to the roof panels 1710. In an alternate embodiment, the roof panels 1710 are oriented with the shear resistance connectors 112 facing downwardly so as to selectively orient the roof panels relative to anticipated loads on the roof, such as snow loads, wind loads or the like.

Figure 18:
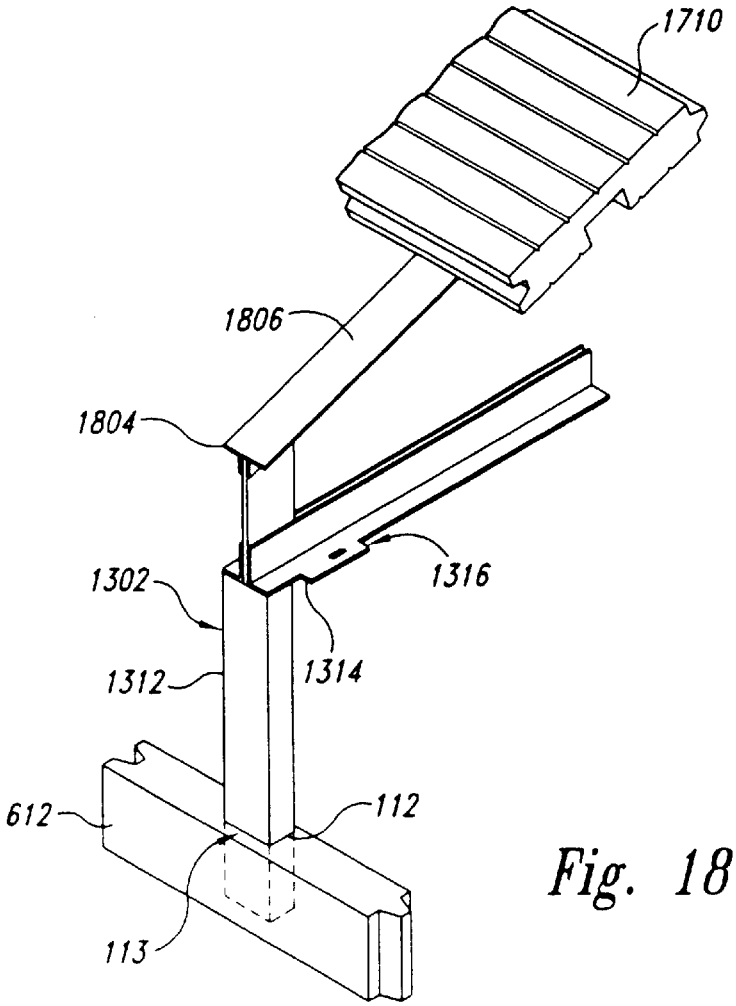
FIG. 18 is a partial cut-away isometric view of a roof truss mounted to a joist support positioned in a shear resistance connector of a wall panel, the wall panel being shown cut away for purposes of clarity.

FIG. 18 illustrates an alternate embodiment providing a joist support 1302 positioned within the open channel 113 in the wall panel 612 as discussed above. A roof truss 1804 is mounted to the joist plate 1314 such that the roof truss extends away from the wall panel 612. The roof truss 1804 has an angled upper mounting surface 1806 that extends under the roof panels 1710 interconnected to define the roof of the building. The roof panels 1710 are interconnected via their joinery and are fastened to the roof truss mounting surface 1806 with conventional fasteners or adhesive.

Figure 19:
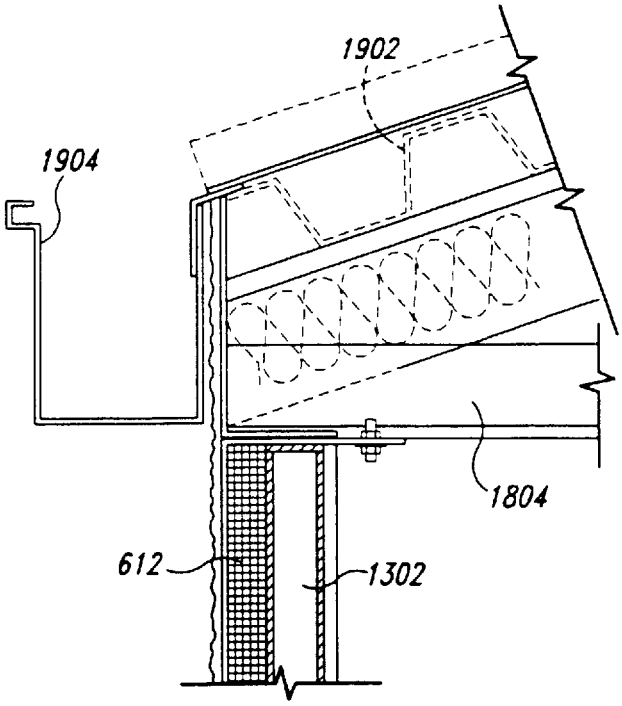
FIG. 19 is a partial cross-sectional view of an alternate embodiment of a wall panel and roof truss of FIG. 18 and a corrugated ceiling/roof.

FIG. 19 is a partial cross-sectional view of an alternate embodiment illustrating the roof truss 1804 mounted to the top of a wall panel 612 and the joist support 1302. The roof truss 1804 supports a corrugated roof deck 1902 and gutters 1904. Accordingly, in alternate embodiments, the roof can be constructed of materials other than the roof panels 1710. The interconnection of the roof truss 1804 to the wall panels 612, however, is the same as described above when the roof truss is used.

Figure 20:
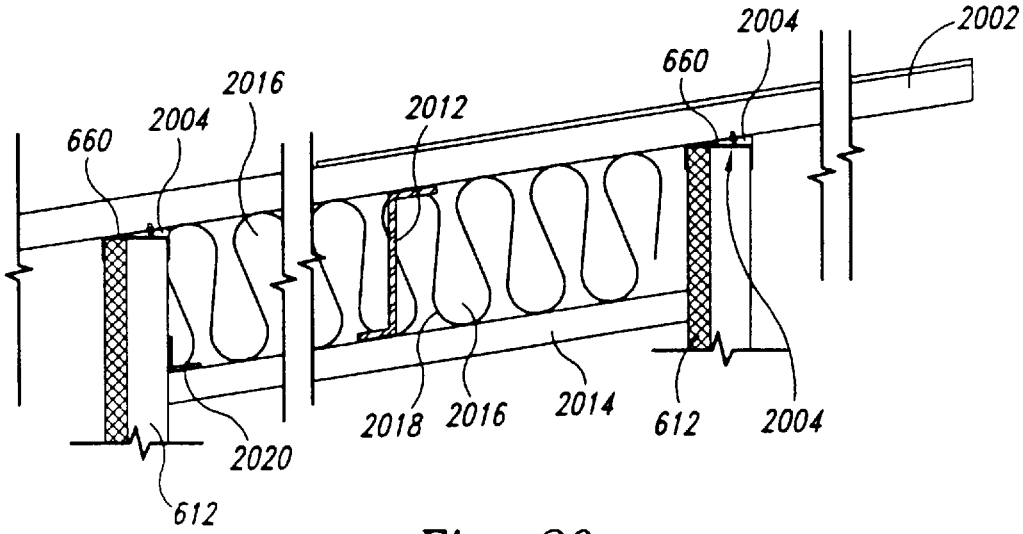
FIG. 20 is an enlarged, cross-sectional view of an alternate embodiment showing a connection between a wall panel and a corrugated metal ceiling/roof in the building system of FIG. 5.

FIG. 20 illustrates a partial cross-section of another alternate embodiment showing the wall panel 612 connected to a conventional corrugated roof 2002. The wall panels include a continuous triangular tube 2004 mounted on the end cap 660 on the top end of the wall panels 612. The triangular tube 2004 has a selected slope corresponding to the design of the roof. The triangular tube 2004 provides connecting hardware between the wall panel 612 and a conventional corrugated metal roof 2002. In one embodiment, metal screws with lock washers or other similar connecting hardware securely retains the corrugated roof 2002 to the triangular tube 2004. A bent spacer/mounting plate beam 2012 is positioned between the corrugated metal roof 2002 and a corrugated metal ceiling 2014 to maintain a selected gap 2016 between the roof and the ceiling. An insulation material 2018 is shown in the gap 2016 to reduce heat loss. The corrugated metal ceiling 2014 is also secured to the wall panel 612 with sheet metal clips 2020.

Figure 21:
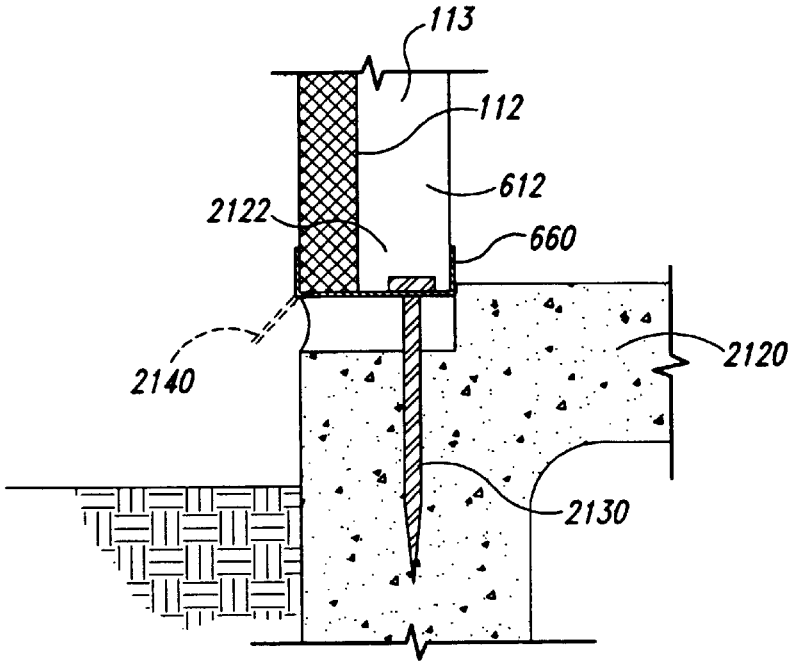
FIG. 21 is an enlarged, cross-sectional view of a connection between a wall panel of FIG. 4 and a foundation.

FIG. 21 illustrates one embodiment of a connection between the bottom of a wall panel 612 in a structural wall panel section and an integral slab and foundation 2120 for the building. The structural wall panel section is positioned on a perimeter edge of the integral slab and foundation 2120. The structural wall panel section includes an end cap 660 shown as a "U" channel, adhered to the wall panels' bottom edge portion 2122. An anchor bolt 2130 extends through the end cap 660 and into the foundation 2120 to securely anchor the wall panels 612 to the foundation. The end cap 660 may contain pre-drilled holes for the anchor bolts 2130 to facilitate placement and installation of the wall panel 612. In the illustrated embodiment, the pre-drilled holes are positioned within the channel formed by the shear resistance connector such that the portion of the anchor bolt engaging the end cap 660 is recessed within the channel 113 formed by the shear resistance connector 112. Thus, the anchor bolt 2130 does not create an interference with face sheets or other decorative face panels attached to the outer surfaces of the wall panels 612.

In the illustrated embodiment, the end cap 660 is an elongated "U" channel shaped and sized to receive a plurality of the wall panels 612 adhered together via the joinery 122, 124 (FIG. 4). Thus, the end caps 660 for the wall panels' bottom edge portions are integrally connected and do not need additional mechanical interconnections. In an alternate embodiment, separate end caps 660 can be used for each of the wall panels 612. After securing an exterior wall panel 612 and the end cap 660 to the foundation 2120, an exterior leg 2140 of the end cap may be bent away from the exterior wall panel to a downwardly sloping position (shown in dashed lines in FIG. 13). In this position, the exterior leg 2140 can direct drainage from an exterior face of the wall panel 612 away from the foundation 2120.

Figure 22:
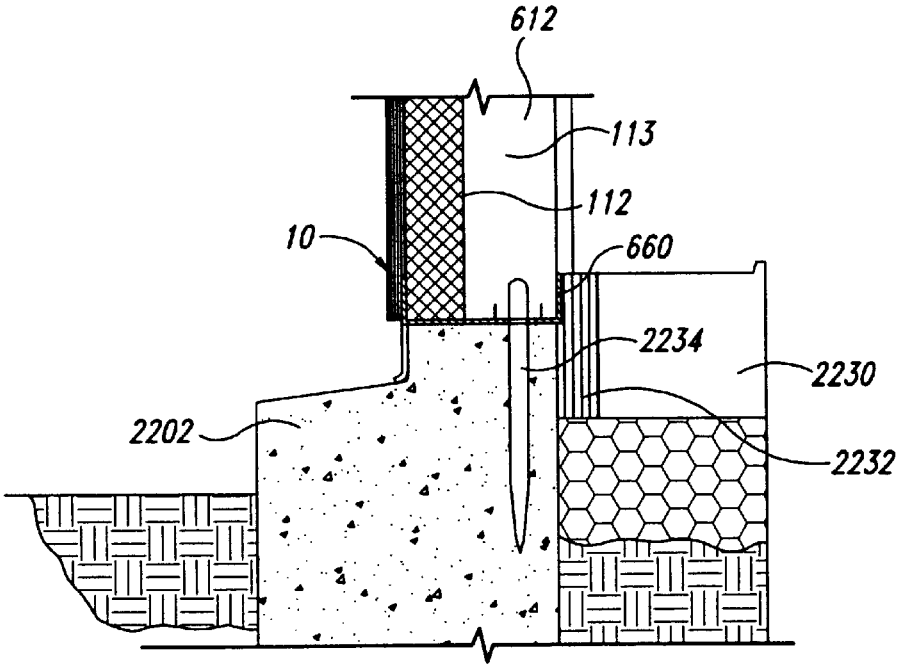
FIG. 22 is a cross-sectional view of an alternate embodiment of a connection between a wall panel of FIG. 4 and a concrete floor.

FIG. 22 illustrates another embodiment of a connection between the exterior wall panel 612 and a foundation 2202. A traditional concrete floor 2230 is shown with a joint 2232 between the concrete floor and the foundation 2202. The joint 2232 can be rigid installation, or, alternatively, a rubberized joint or other suitable material can be used. The exterior wall panel 612 with its end cap 660 or similar connecting hardware to provide an anchoring point for an anchor bolt 2234 that extends through the end cap and into the foundation 2202. The wall panel 612 is positioned on the foundation 2202 adjacent to and abutting a portion of the joint 2232. The anchor bolt 2234 secures a connection between a wall panel 612 and the foundation 2202.

Figure 23:
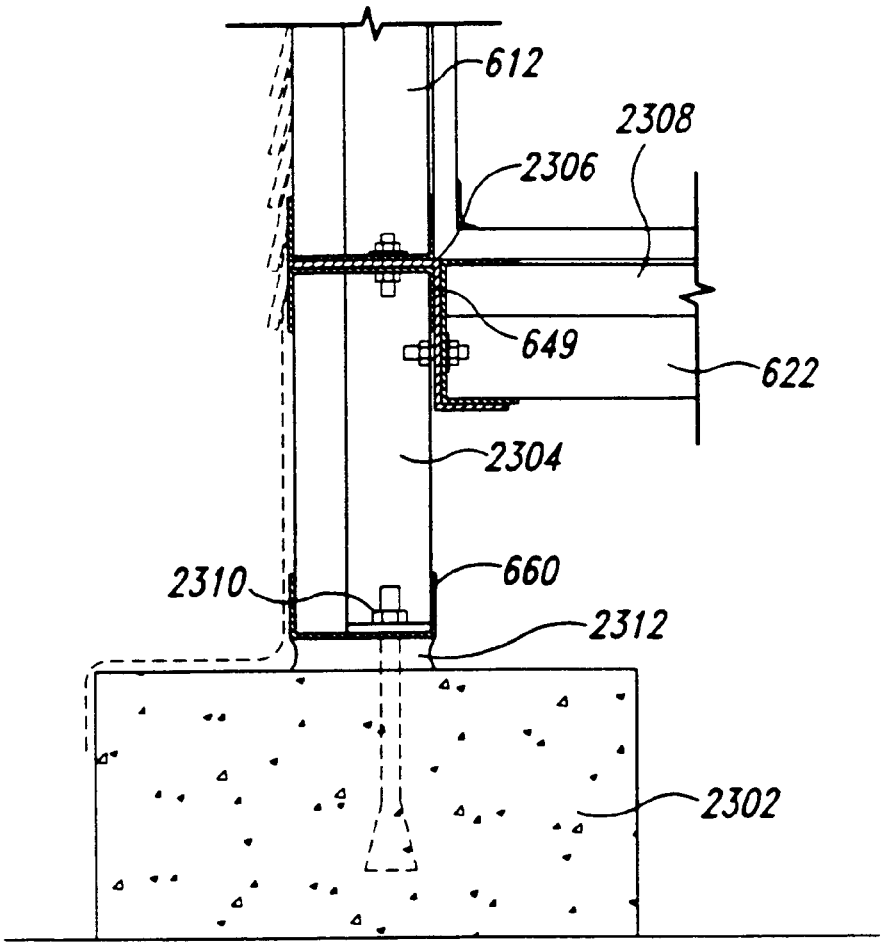
FIG. 23 is an enlarged cross-sectional view of wall panels and a floor panel of FIG. 4 mounted on a foundation wall.

FIG. 23 illustrates an alternate embodiment interconnecting the wall panel 612 to a foundation 2302 by a composite spacer panel 2304. The spacer panels 2304 are also illustrated in FIG. 4. The bottom end of the wall panel 612 is securely fastened to the spacer panel 2304 that has the same composite construction as the wall panel 612, but is shorter in height. Thus, the spacer wall 2304 spaces the wall panel 612 above the foundation 2302. A hanger assembly 649 is sandwiched between the wall panel 612 and the top of the spacer panel 2304. A floor/ceiling panel 622 is mounted to the hanger assembly 649 in the manner as described above. Accordingly, the floor/ceiling panel 622 is securely retained at a selected distance above the foundation 2302.

The spacer panel 2304 is connected at its bottom end to the foundation 2302 by an anchor bolt 2310 extending from the foundation and through the bottom end cap 660. In the illustrated embodiment, the bottom end cap 660 on the spacer panel 2304 is spaced apart from the foundation 2302 by a grout leveling bed 2312. In alternate embodiments, the spacer panels' bottom end cap 660 can be placed directly onto the foundation 2302. In the illustrated embodiment, the bottom end cap 660 is an elongated "U" channel that is adapted to receive a plurality of the interconnected spacer panels 2304. The joinery formed between the spacer panels 2304 forms an integral post therein that aligns with the integral post formed by the joinery of the plurality of wall panels 612. Accordingly, the structural strength provided by the integral posts are provided down to the foundation 2302.

Figure 24:
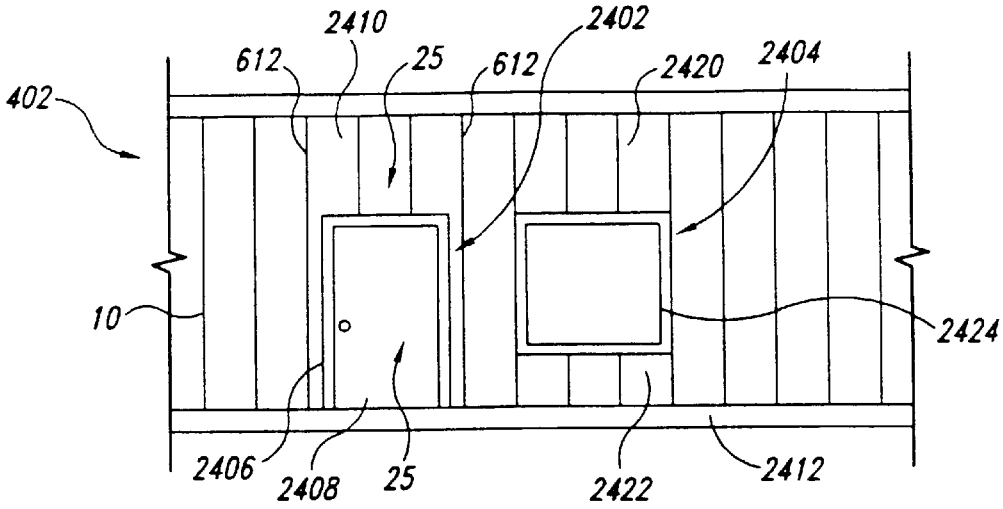
FIG. 24 is an enlarged, elevation view of one of the building systems of FIG. 5 with a building structure constructed with the frameless panels and having a door and window in an exterior wall.
Figure 25:
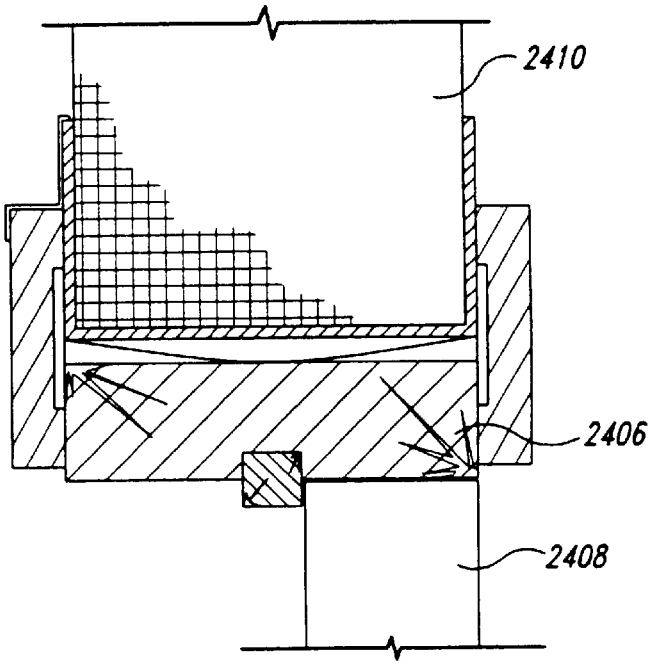
FIG. 25 is an enlarged, cross-sectional view taken substantially along line 25—25 of FIG. 24 showing a door header in accordance with an embodiment of the present invention.

FIG. 24 illustrates a plan view of an embodiment of a frameless building structure 402 that includes openings in the frameless interconnected wall panels 612 to form a doorway 2402 and a window opening 2404. FIG. 25 illustrates an embodiment of a door frame 2406 in the doorway 2402 to support a door 2408 positioned within the frameless wall panels 612. The doorway 2402 is defined by an opening in the wall formed by the plurality of wall panels 612. The doorway 2402 is formed by providing a shortened wall panel 2410 between two adjacent wall panels 612, such that the shortened wall panel is space away from the floor 2412. In one embodiment, the floor 2412 is defined by a plurality of interconnected floor/ceiling panels 622. In another embodiment, the floor is provided by conventional flooring mounted on the slab foundation. Accordingly, a space is provided below the shortened wall panel 2410 between the adjacent wall panels 612 so as to form the doorway 2402. The door frame 2406 is positioned within the doorway 2402. The door frame 2406 is a conventional door frame that includes door jambs, a door header, and molding all interconnected to provide structure for hanging the door 2408.

FIGS. 26, 27, and 28 illustrate the alternate embodiments for connecting the door header and the door jambs of the door frame to the wall panel 612 and shortened wall panel 2410. As shown in FIG. 26, one embodiment has the door header 2602 attached to the shortened wall panel 2410 by a composite spacer panel 2604. This spacer panel 2604 is adhered to the shortened wall panel 2410, and the door header 2602 is secured to the spacer panel. The spacer panel 2604 is substantially the same width as the wall panel 2410 and can be a selected height to allow any size opening to be accommodated. FIG. 27 illustrates the door jamb 2702 secured to the adjacent wall panel 612 by a composite spacer panel 2704. In this embodiment, the spacer panel 2704 is substantially the same width as the wall panel 612 and includes integral symmetrical groove joinery 2706 that mates with the integral symmetrical tongue joinery 124 of the wall panel 612. The groove joinery 2706 of the spacer panel 2704 is adhered to the tongue joinery 124 of the wall panel 612.

FIG. 28 illustrates a cross-sectional view of an alternate embodiment that includes the door jamb 2702 connected to the wall panel 612 via a composite spacer panel 2802. The wall panel 612 has symmetrical groove joinery 122 and the spacer panel 2802 has a symmetrical tongue joinery 2804. The tongue joinery 2804 of the spacer panel 2802 is inserted into and bonded with the groove joinery 122 of the wall panel 612 to form a connection between the spacer panel and the wall panel.

Referring again to FIG. 24, the window opening 2404 is formed by sandwiching shortened upper and lower wall panels 2420 and 2422 between two wall panels 612 so as to form an opening between the two shortened wall panels at an intermediate position in the wall. Positioning of the window opening is defined by the dimensions of the shortened upper and lower wall panels 2420 and 2422. The shortened upper and lower wall panels 2420 and 2422 can be cut to a selected size in the field or can be manufactured in a factory and shipped to the building site. The window opening 2404 is adapted to receive a conventional window frame 2424 or other selected window structure.

FIGS. 29 and 30 illustrate embodiments of the frame for the window opening 2404. FIG. 29 illustrates a wall panel 612 with groove joinery 122 and a spacer panel 2902 with a symmetrical tongue joinery 2904 inserted into and bonded to the groove joinery. FIG. 30 illustrates a wall panel 612 with symmetrical tongue joinery 124 and a spacer panel 3002 with groove symmetrical joinery 3004. The spacer panels 2902, 3002 act as a jamb post or frame for the window opening 2404. As shown, a post 3010 may be used as a filler to accommodate any size window opening 2404.

The ability to construct the entire building system, including multiple story buildings from the frameless building panels or to combine the frameless building system with a conventional floor, a conventional roof, a conventional ceiling or conventional partitions, increases the versatility of the system and allows for efficient integration of the building system with existing materials. Further, easy incorporation of conventional door, window, and other opening frames into the frameless building system provides yet another level of versatility and building efficiency.

From the foregoing, it will be appreciated that, although specific embodiments of the invention have been described herein for purposes of illustration, various modifications may be made without deviating from the spirit and scope of the invention. Accordingly, the invention is not limited except as by the appended claims.

I claim:

1. A frameless building system for use in constructing a building with a wall, a floor, and a ceiling, comprising:

a plurality of composite first panels interconnected to form the wall of the building, each of the first panels including front and back side portions positioned opposite each other, joinery portions integral to the front and back side portions forming symmetrical joinery members, an interior area defined by the front and back sections with the integral joinery portions, an insulating core in the interior area, and a shear resistance connector projecting from one of the side portions into the insulating core, wherein adjacent ones of the first panels are joined together at the integral joinery to form a load-bearing integral post structure in the wall; and a plurality of composite second panels interconnected to form one of the floor or ceiling, the second panels having substantially the same construction as the first panels, wherein adjacent ones of the second panels are joined together at the integral joinery to form an integral beam structure in the one of the floor or ceiling, the plurality of the second panels forming the one of the floor or ceiling being connected to the first panels forming the wall to connect the wall to the floor or ceiling.

2. The frameless building system of claim 1 wherein the first panels are interconnected and form an exterior wall of the building, and the first panels being oriented with the side of the panels from which the shear resistance connectors extends face inwardly toward an interior of the building.

3. The frameless building system of claim 1 wherein the second panels form the floor, and the second panels being oriented with the side of the panels from which the shear resistance connectors extends face downwardly.

4. The frameless building system of claim 1 wherein the second panels form the ceiling, and the second panels being oriented with the side of the panels from which the shear resistance connectors extends face upwardly.

5. The frameless building system of claim 1 wherein the joinery portions of the adjacent first panels are adhered together by an adhesive.

6. The frameless building system of claim 1 wherein the second panels form the floor, and further comprising a plurality of composite third panels interconnected to form the ceiling, the third panels having substantially the same construction as the first and second panels with the integral joinery, wherein adjacent ones of the third panels are joined together at the integral joinery to form an integral beam structure in the ceiling, the plurality of the third panels are spaced apart from the second panels and are connected to the first panels to connect the wall to the ceiling.

7. The frameless building system of claim 1, further comprising a connector member securely attached to the second panels, and the first panels are connected to the connector member in a selected orientation to retain the wall in a desired orientation relative to the one of the floor or ceiling.

8. The frameless building system of claim 1 wherein the shear resistance connectors in the first panels have a generally U-shaped cross section forming an elongated channel in the first panel, and further comprising an elongated building structure contained in at least one of the elongated channels.

9. The frameless building system of claim 8 wherein the elongated building structure is a floor-joist support member.

10. The frameless building system of claim 1, further comprising a plurality of floor-joist support members attached to the shear resistant connectors in the first panels, and further comprising floor joists connected to the floor-joist support members.

11. The frameless building system of claim 1 wherein the plurality of first panels include two of the first panels forming corner panels interconnected at a selected angle relative to each other to form a corner wall portion.

12. The frameless building system of claim 11, further comprising a corner post interconnecting the two corner panels, the corner post having joinery portion that mate with the joinery of the two corner panels.

13. The frameless building system of claim 11 wherein a first one of the corner panels is positioned with its joinery portions engaging the shear resistance connector of the other corner panel.

14. The frameless building system of claim 13, further comprising a corner bracket interconnecting the corner panels.

15. The frameless building system of claim 1 wherein the wall formed by the first panel is a first wall, and further comprising a plurality of composite third panels interconnected to form a second wall atop and substantially coplanar with the first wall, the third panels having substantially the same construction as the first and second panels with the integral joinery, wherein adjacent ones of the third panels are joined together at the integral joinery to form a load bearing integral post structure in the second wall.

16. The frameless building system of claim 15 wherein the integral post in the second wall is axially aligned with the integral post structure in the first wall.

17. The frameless building system of claim 15 wherein the second panels are connected to the first and third panels, the second panels forming a floor structure adjacent to a top edge portion of the first panels and a bottom edge portion of the third panels.

18. The frameless building system of claim 17, further comprising a connector member interconnecting the second panels to the first and third panels.

19. The frameless building system of claim 15 wherein the second panels form the floor adjacent to a bottom edge portion the first panels, and further comprising a plurality of fourth panels interconnected to form the ceiling above the floor, the fourth panels having substantially the same construction as the first, second, and third panels with the integral joinery, wherein adjacent ones of the fourth panels are joined together at the integral joinery to form an integral beam structure in the ceiling, the fourth panels being adjacent to a top edge portion of the first panels and a bottom edge portion of the third panels.

20. The frameless building system of claim 19 wherein the floor connected fourth panels define a second floor connected to the first and third panels and spaced apart from first floor formed by the second panels.

21. The frameless building system of claim 1, further comprising an elongated first connection member attached to one of the top and bottom edge portions of the composite first panels forming a first structural panel section and an elongated second connection member attached to one of the top and bottom portions of the composite second panels forming a second structural panel section.

22. The frameless building system of claim 1 wherein the first and second connection members are end caps having generally U-shaped cross-sectional shapes.

23. A frameless building system for use in constructing a building with a wall, a floor, and a ceiling, comprising:

a plurality of asymmetric composite, foam-filled metal first panels interconnected to form the wall of the building, each of the first panels including metal front and back side portions positioned opposite each other, joinery portions integral to the front and back side portions forming symmetrical joinery member, an interior area defined by the front and back sections with the integral joinery portions, a foam core in the interior area, and a shear resistance connector projecting from one of the side portions into the foam core to provide an asymmetric panel about a plane extending through the joinery portions, wherein adjacent ones of the first panels are joined together at the integral joinery; and a plurality of asymmetric, composite, foam-filled metal second panels interconnected to form one of the floor or ceiling, the second panels having substantially the same construction as the first panels, wherein adjacent ones of the second panels are joined together at the integral joinery portions to form an integral beam structure in the one of the floor or ceiling, the plurality of the second panels forming the one of the floor or ceiling being connected to the first panels forming the wall to connect the wall to the floor or ceiling.

24. The frameless building system of claim 23 wherein the first panels are interconnected and form an exterior wall of the building.

25. The frameless building system of claim 24 wherein the first panels being oriented with the side of the panels from which the shear resistance connectors extends face inwardly toward an interior of the building.

26. The frameless building system of claim 23 wherein the second panels form the floor, and further comprising a plurality of third panels interconnected to form the ceiling, the third panels having substantially the same construction as the first and second panels, the plurality of the third panels being spaced apart from the second panels and are connected to the first panels to connect the wall to the ceiling.

27. The frameless building system of claim 23 wherein the shear resistance connectors in the first panels have a generally U-shaped cross section forming an elongated channel in the first panel, and further comprising an elongated building structure contained in at least one of the elongated channels.

28. The frameless building system of claim 23 wherein the plurality of first panels include two of the first panels forming corner panels interconnected at a selected angle relative to each other to form a corner wall portion.

29. The frameless building system of claim 23 wherein a first one of the corner panels is positioned with its joinery portions engaging the shear resistance connector of the other corner panel.

30. The frameless building system of claim 23 wherein the wall formed by the first panel is a first wall, and further comprising a plurality of third panels interconnected to form a second wall atop and substantially coplanar with the first wall, the third panels having substantially the same construction as the first and second panels.

31. The frameless building system of claim 30 wherein the second panels are connected to the first and third panels, the second panels forming a floor structure adjacent to a top edge portion of the first panels and a bottom edge portion of the third panels.

32. The frameless building system of claim 1, further comprising a plurality of panels interconnected to form a roof structure coupled to the wall, the third panels having substantially the same construction as the first and second panels, wherein adjacent ones of the third panels are joined together at the integral joinery to form an integral beam structure in the roof structure.

33. A building, comprising:

a plurality of interconnected composite structural panels, each panel including front and back side portions positioned opposite each other, joinery portions integral to the front and back side portions forming a symmetrical joinery member, each joinery member having a thermal break therein, an interior area defined by the front and back sections with the integral joinery portions, an insulating core in the interior area, and a shear resistance connector projecting from one of the side portions into the insulating core;

a floor comprising a plurality of the interconnected composite structural panels;

a plurality of frameless wall panels, the wall panels comprising interconnected composite structural panels, the wall panels including a connection between an edge adjacent to the floor and the floor; and a ceiling or roof or combined ceiling/roof structure comprising a plurality of the interconnected composite structural panels, the ceiling or roof or combined ceiling/roof structure including a connection between a top edge of the wall panels adjacent the ceiling or roof or combined ceiling/roof structure and an underneath surface of the ceiling or roof or combined ceiling/roof structure.

34. The building of claim 33, further comprising an elongated connection member attached to one of the top and bottom portions of the wall panel to form a structural wall panel section.

35. The building of claim 33, further comprising an elongated connection member attached to end portions of the floor to form a structural floor panel section.

36. A method of constructing a building, comprising:

providing a plurality of composite building panels each including front and back side portions positioned opposite each other, joinery portions integral to the front and back side portions forming symmetrical joinery member, an interior area defined by the front and back sections with the integral joinery portions, an insulating core in the interior area, and a shear resistance connector integrally formed in or projecting from one of the side portions into the insulating core;

interconnecting a first plurality of the composite building panels to form walls of the building, adjacent ones of the building panels forming the wall are joined together at the integral joinery to form a load-bearing integral post structure in the wall;

interconnecting a second plurality of the composite building panels to form one of a floor or a ceiling in the building, adjacent ones of the building panels forming the floor or ceiling are joined together at the integral joinery to form a load-bearing integral beam structure in the floor or ceiling; and connecting the first plurality of the composite building panels to the second plurality of composite building panels to connect the walls to the floor or ceiling.

37. The method of claim 36, further comprising interconnecting two of the first plurality of the composite building panels together at a selected angle relative to each other to form a corner portion of the wall.

38. The method of claim 36, further comprising fixedly connecting bottom portions of the first plurality of building panels to a foundation structure of the building.

39. The method of claim 36 wherein the walls formed by the first plurality of composite panels are lower walls, and further comprising interconnecting a third plurality of the composite building panels to form upper walls of the building, adjacent ones of the building panels forming the second walls are joined together at the integral joinery to form a load-bearing integral post structure in the second wall.

40. The method of claim 39, further comprising connecting the third plurality of composite panels atop the first plurality of composite panels.

41. The method of claim 36, further comprising mounting a plurality of floor-joist support members to the composite panels in the first plurality of composite panels with the floor joist support members being adjacent to the shear resistant connectors in the first panels, and mounting floor joists to the floor-joist support members.

42. The method of claim 41, further comprising connecting the second plurality of composite panels to the floor joists.

43. The method of claim 41 wherein the first plurality of composite panels form a first floor, and further comprising interconnecting a third plurality of the composite building panels with adjacent ones of the building panels in the third plurality being joined together at the integral joinery to form an integral beam structure, and connecting the third plurality of composite panels to the floor joists.

* * * * *